US007080597B2

(12) United States Patent
Ando

(10) Patent No.: US 7,080,597 B2
(45) Date of Patent: Jul. 25, 2006

(54) ELECTROSTATIC PRINTING DEVICE AND ELECTROSTATIC PRINTING METHOD

(75) Inventor: Kesao Ando, Asaka (JP)

(73) Assignee: Berg Industry Co., Ltd., Saitama (JP)

( * ) Notice: Subject to any disclaimer, the term of this patent is extended or adjusted under 35 U.S.C. 154(b) by 56 days.

(21) Appl. No.: 10/481,744

(22) PCT Filed: Jun. 24, 2002

(86) PCT No.: PCT/JP02/06271

§ 371 (c)(1),
(2), (4) Date: Jul. 27, 2004

(87) PCT Pub. No.: WO03/002348

PCT Pub. Date: Jan. 9, 2003

(65) Prior Publication Data

US 2004/0250715 A1 Dec. 16, 2004

(30) Foreign Application Priority Data

Jun. 27, 2001 (JP) ..... 2001-195296
Sep. 28, 2001 (JP) ..... 2001-302626
Dec. 11, 2001 (JP) ..... 2001-377804

(51) Int. Cl.
*B41M 1/42* (2006.01)

(52) U.S. Cl. ..... 101/114

(58) Field of Classification Search ..... None
See application file for complete search history.

(56) References Cited

U.S. PATENT DOCUMENTS 3,285,167 A * 11/1966 Childress et al. ..... 101/114
3,358,594 A * 12/1967 Thompson ..... 101/114
3,665,851 A * 5/1972 Edwards et al. ..... 101/114

FOREIGN PATENT DOCUMENTS

| | | |
|---|---|---|
| EP | 0 265 884 | 5/1988 |
| JP | 49-14686 | 4/1974 |
| JP | 50-30610 | 3/1975 |
| JP | 50-95014 | 7/1975 |
| JP | 51-94311 | 8/1976 |
| JP | 52-81186 | 7/1977 |
| JP | 53-103087 | 9/1978 |
| JP | 56-115240 | 9/1981 |
| JP | 57-167049 | 10/1982 |

(Continued)

*Primary Examiner*—Daniel J. Colilla
(74) *Attorney, Agent, or Firm*—Wenderoth, Lind & Ponack, L.L.P.

(57) ABSTRACT

An electrostatic printing apparatus according to the present invention rubs powdery ink into a screen having a predetermined printed pattern formed therein, and applies a voltage between the screen and an object so as to attach the powdery ink to the object. A plurality of screens (34*a*–34*d*) are provided so that the plurality of screens are movable to a position located above the object (1). The plurality of screens (34*a*–34*d*) are provided so as to be rotatable about a shaft (46). The screens (34*a*–34*d*) are rotated about the shaft (46) to move the screens (34*a*–34*d*) to the position located above the object (1).

1 Claim, 32 Drawing Sheets

FOREIGN PATENT DOCUMENTS

| | | |
|---|---|---|
| JP | 58-201689 | 11/1983 |
| JP | 61-181367 | 8/1986 |
| JP | 62-63138 | 4/1987 |
| JP | 63-162774 | 7/1988 |
| JP | 63-164842 | 7/1988 |
| JP | 63-163189 | 10/1988 |
| JP | 63-170135 | 11/1988 |
| JP | 2-178046 | 7/1990 |
| JP | 3-151865 | 6/1991 |
| JP | 4-25463 | 1/1992 |
| JP | 4-183360 | 6/1992 |
| JP | 6-234204 | 8/1994 |
| JP | 7-205401 | 8/1995 |
| JP | 9-171 | 1/1997 |
| JP | 10-150927 | 6/1998 |
| JP | 11-28080 | 2/1999 |
| JP | 11-46733 | 2/1999 |
| JP | 11-300941 | 11/1999 |
| JP | 2001-129963 | 5/2001 |

* cited by examiner

ELECTROSTATIC PRINTING DEVICE AND ELECTROSTATIC PRINTING METHOD

TECHNICAL FIELD

The present invention relates to an electrostatic printing apparatus and an electrostatic printing method, and more particularly to an electrostatic printing apparatus and an electrostatic printing method for attaching powdery ink onto a surface of an object by using an electrostatic force to print a printed pattern including characters and figures on the surface of the object. The present invention relates to a food producing method, and more particularly to a food producing method using an electrostatic printing apparatus utilizing an electrostatic force.

BACKGROUND ART

There has heretofore been known an electrostatic printing apparatus for attaching powdery ink onto a surface of an object by using an electrostatic force to print a printed pattern including characters and figures on the surface of the object. A conventional electrostatic printing apparatus can perform printing only with one-colored powdery ink. Therefore, when multicolored printing is to be performed on an object, it is necessary to provide the same number of electrostatic printing apparatuses as the number of colors to be used.

FIG. 41 is a vertical cross-sectional view showing an arrangement of a conventional electrostatic printing apparatus for performing three-colored printing. In an example shown in FIG. 41, an electrostatic printing apparatus 500*a* first performs printing with a first color, and then a pallet 550 having an object 1 placed thereon is transferred to the next electrostatic printing apparatus 500*b*. The electrostatic printing apparatus 500*b* performs printing with a second color. After the electrostatic printing apparatus 500*b* performs printing with the second color, the pallet 550 is further transferred to the next electrostatic printing apparatus 500*c*, which performs printing with a third color. Thus, when multicolored printing is to be performed with use of a conventional electrostatic printing apparatus, it is necessary to provide a plurality of electrostatic printing apparatuses and to perform printing with each color in each electrostatic printing apparatus.

As described above, when multicolored printing is to be performed with use of a conventional electrostatic printing apparatus, it is necessary to provide the same number of electrostatic printing apparatuses as the number of colors to be used. Therefore, a wide space is required for installing the apparatuses, and cost is highly increased to perform multicolored printing.

Further, when a pallet having an object placed thereon is transferred to the next electrostatic printing apparatus, the pallet may get out of position with respect to a screen, or the object may get out of position in the pallet by vibration or shock during transferring. In such a case, printing positions become different according to colors, and hence accurate and clean printing cannot be performed on the object.

FIG. 42 is a schematic diagram showing an arrangement of a conventional electrostatic printing apparatus. The conventional electrostatic printing apparatus has a stencil screen 610 disposed above an object 600, a rotation brush 620 on the screen 610, and a hopper 640 for supplying powdery ink 630 onto the brush 620. A printed pattern including characters and figures is formed of a mesh 611 on the screen.

The powdery ink 630 supplied from the hopper 640 is pushed out downwardly through the mesh 611 of the screen 610 by rotation of the brush 620. A high direct-current voltage is applied between the object 600 and the screen 610 by a direct-current power supply DC to form an electrostatic field between the object 600 and the screen 610. The powdery ink which has passed through the mesh 611 and has thus been charged travels straight toward the object 600, which serves as a counter electrode, in the electrostatic field and is attached to a surface of the object 600. Thus, a printed pattern in the screen 610 which includes characters and figures is printed on the surface of the object 600.

However, in the conventional electrostatic printing apparatus, when printing is to be performed continuously on a plurality of objects, each object 600 needs to be disposed below the screen 610 before printing. Therefore, processing time required before printing becomes long, and a printing process becomes troublesome. Thus, the conventional electrostatic printing apparatus cannot practically perform continuous printing.

Incidentally, as shown in FIG. 43, when a mold releasing agent or other edible powder is applied onto a food molding receptacle, edible powder 710 is dropped from above the food molding receptacle by shaking a screen 700 having a mesh in a lattice pattern and is attached to inner surfaces of the molding receptacle 720.

However, it is difficult to attach the edible powder 710 to side surfaces or inclined surfaces of the molding receptacle 720 by using the screen 700. Thus, the edible powder 710 is dropped onto a bottom of the molding receptacle and accumulated thereon. Further, since the edible powder 710 needs to be dropped through the screen 700, powder having a relatively large particle diameter should be selected as the edible powder 710. However, since powder having a large particle diameter has a large weight, the powder is unlikely to be attached to side surfaces of the molding receptacle 720 in particular and is likely to be dropped onto a bottom of the molding receptacle 720 by its weight and accumulated thereon. Thus, it is difficult to apply the edible powder 710 uniformly onto inner surfaces of the molding receptacle 720. Even if the edible powder 710 can be attached to the side surfaces of the molding receptacle 720, the edible powder 710 is likely to be detached by small shock and dropped onto the bottom because the edible powder 710 has a small adhesive strength when the screen 700 is used to apply the edible powder 710. Further, when the screen 700 is employed to apply the edible powder 710, the edible powder 710 is dropped not only to the inside of the molding receptacle 720, but also to the outside of the molding receptacle 720 because the screen 700 is shaken. Thus, the conventional electrostatic printing apparatus consumes the edible powder uselessly.

Further, in addition to the aforementioned method using a screen, as shown in FIG. 44, when edible powder is to be applied onto surfaces of molded foods, molded foods 810 and edible powder 820 are introduced into a rotation drum 800, and then the rotation drum 800 is rotated to attach the edible powder 820 onto surfaces of the molded foods 810. However, when the rotation drum 800 is rotated, the foods 800 are brought into contact with each other and lose their shapes, so that commercial values of the foods are lowered.

In order to season a food, seasoning is usually added to the food during processing the food in the following manners. Seasoning is mixed with a food, and the food is kneaded. Liquid seasoning is sprinkled and added onto a surface of a food. Alternatively, powdery seasoning is applied on a surface of a food with use of the aforementioned screen.

However, in a case where seasoning is mixed with and added to a food, if the food with which the seasoning is mixed is subjected to a heating process or the like, then functions and flavor of the seasoning may be spoiled by heating. Generally, natural pigment or the like is weak to heat and may be discolored during the heating process.

In a case where seasoning is sprinkled and added onto a surface of a food, liquid seasoning is generally used. However, if such liquid seasoning is applied to some kinds of foods, then flavor and mouthfeel of the foods may be spoiled under the influence of moisture in the liquid seasoning. For example, if liquid seasoning is applied to flavor dried layer, then a food body is melted by moisture, so that the food loses its original functions.

For example, when powder such as cocoa powder is applied onto a surface of a semi-solid such as pudding or jelly with use of a screen, because the powder has a small adhesive strength, the cocoa powder applied to the surface of the food may be detached by shock during transportation of the food, or the detached cocoa powder may be solidified, so that taste and beauty of the food may be spoiled.

There has been attempted to apply liquid edible ink onto an edible sheet by letterpress printing, then place the edible sheet on a food and transcribe a pattern printed of the edible sheet to the food. When an edible sheet is placed on a surface of a food having moisture, the edible sheet is melted on the surface of the food by moisture to thus transcribe a pattern printed by liquid ink to the surface of the food.

However, since this method employs liquid edible ink, it is necessary to thicken dough of the edible sheet or to provide water resistance with the sheet in order to maintain resistance to moisture of the ink during printing. A food to which a pattern is transcribed by using such an edible sheet has spoiled taste and mouthfeel.

In order to form a food, it has heretofore been necessary to pour a material into a mold or to manually make a shape of a food. Thus, much labor is required to form a food. For example, bekkou candy is produced as follows. Boiled sugar is dropped from a nozzle with a certain pattern onto an iron plate and then cooled to solidify the sugar. The solidified sugar is separated from the iron plate to obtain bekkou candy. Skill to a certain degree has been required to produce such a molded food. Further, when fresh cream is decorated on a sponge cake to produce a fancy cake, a clean fancy cake cannot be produced by those who are not a skilled worker.

DISCLOSURE OF INVENTION

The present invention has been made in view of the above drawbacks of the prior art. It is, therefore, a first object of the present invention to provide an electrostatic printing apparatus and an electrostatic printing method which can perform accurate and clean printing with a compact arrangement at low cost.

Further, a second object of the present invention is to provide an electrostatic printing apparatus which can continuously perform uniform and clean printing and reduce useless consumption of powdery ink.

Furthermore, a third object of the present invention is to provide a food producing method which can attach edible powder uniformly and firmly onto an inner surface of a food molding receptacle to reduce useless consumption of edible powder and readily produce a clean food having good appearance.

Further, a fourth object of the present invention is to provide a food producing method which can firmly attach seasoning to a molded food without spoiling flavor and mouthfeel of the seasoning added to the molded food.

Furthermore, a fifth object of the present invention is to provide a food producing method which can readily produce a deep-fried food without deep-frying a food in high-temperature oil.

Further, a sixth object of the present invention is to provide a food producing method which can employ a thin edible sheet and transcribe a pattern of the edible sheet to a food without spoiling flavor and mouthfeel of the food.

Furthermore, a seventh object of the present invention is to provide a food producing method which can firmly attach edible powder having a large particle diameter onto a surface of a food to produce a food having good appearance and mouthfeel.

Further, a ninth object of the present invention is to provide a food producing method which allows those who have no skill or experience to readily produce a food having a complicated shape.

In order to attain the first object, according to a first aspect of the present invention, there is provided an electrostatic printing apparatus for rubbing powdery ink into a screen having a predetermined printed pattern formed therein, and applying a voltage between the screen and an object so as to attach the powdery ink to the object, the electrostatic printing apparatus characterized in that a plurality of screens are provided so that the plurality of screens are movable to a position located above the object.

According to a preferred aspect of the present invention, the electrostatic printing apparatus is characterized in that the plurality of screens are provided so as to be rotatable about a shaft; and the screens are rotated about the shaft to move the screens to the position located above the object.

According to a preferred aspect of the present invention, the electrostatic printing apparatus is characterized in that the plurality of screens are provided so as to be slidable in a horizontal direction; and the screens are horizontally moved direction to move the screens to the position located above the object.

With such an arrangement, multicolored printing can be achieved by only one electrostatic printing apparatus without providing a plurality of electrostatic printing apparatuses unlike a conventional method. Therefore, a space for installation can be reduced to achieve a compact arrangement. Further, the apparatus requires only one high-voltage direct-current power supply and one device for various purposes. Therefore, cost to perform multicolored printing can remarkably be reduced.

Further, multicolored printing can be achieved by powdery ink having different colors in a state such that the object remains stationary. Therefore, printing positions are not different position according to colors. Hence, accurate and clean printing can be achieved on the object.

In these cases, different colors or types of powdery ink can be rubbed into the plurality of screens. When different colors of powdery ink are used, it is possible to perform multicolored printing. When different types of powdery ink are used, it is possible to perform multitype printing. It can be considered that different types of powdery ink including cocoa powder and sugar powder are printed one over the other on an object such as confectionery to perform multitype printing. In the present specification, powdery ink means any powder to be attached to an object whether or not it is colored.

According to a second aspect of the present invention, there is provided an electrostatic printing method of rubbing powdery ink into a screen having a predetermined printed pattern formed therein, and applying a voltage between the screen and an object so as to attach the powdery ink to the object, the electrostatic printing method characterized in that a plurality of screens are sequentially moved to a position located above the object in a state such that the object remains stationary.

In order to attain the second object, according to a third aspect of the present invention, there is provided an electrostatic printing apparatus for rubbing powdery ink into a screen having a predetermined printed pattern formed therein, and applying a voltage between the screen and an object so as to attach the powdery ink to the object, the electrostatic printing apparatus characterized by comprising a carrier conveyer for transferring the object; a screen moving mechanism for moving a plurality of screens to a position located above the object moved by the carrier conveyer; and a synchronizing mechanism for synchronizing a moving speed of the object by the carrier conveyer and a moving speed of the screen by the screen moving mechanism.

With the above arrangement, since electrostatic printing can be performed continuously, a printing speed is remarkably improved to enhance a printing efficiency. Further, an electrostatic printing apparatus can be made compact and lightweight with a simple arrangement and provided at low cost. Furthermore, it is not necessary to stop operation of the apparatus for the purpose of cleaning the screen, and hence a rate of operation can be improved.

According to a preferred aspect of the present invention, the electrostatic printing apparatus is characterized by comprising a height detecting sensor for detecting a height of the object on the carrier conveyer at an upstream side of a printing position; and a lifter for vertically moving the carrier conveyer according to the height of the object based on a detected result from the height detecting sensor.

In view of performing clear printing, it is ideal that a distance (printing distance) between a surface of an object to be printed and the screen should be a minimum distance such that electric discharge is not developed between the object and the screen. The heights of the objects differ depending on the objects. If a distance between the carrier conveyer and the screen is fixed at a constant value, optimal printing distances cannot be obtained for each object. Therefore, the heights of the respective objects are detected by the height detecting sensor, and a lifting distance of the lifter is adjusted based on outputs from the height detecting sensor to achieve optimal printing distances according to the heights of the respective objects. Thus, the electrostatic printing apparatus according to the present invention can perform clear and clean printing even if the respective objects have different heights.

According to a preferred aspect of the present invention, the electrostatic printing apparatus is characterized by comprising a screen unit having a flat plate including an opening portion at which the screen is disposed, and a side plate attached to an upper surface of one of lateral portions of the flat plate, wherein the side plate has a clamping portion for clamping the screen disposed at the opening portion, and a projecting portion projecting from the one of lateral portions of the flat plate, wherein the projecting portion of the side plate has a length longer than a distance from the other of the lateral portions to the opening portion.

With such an arrangement, when two screen units are positioned adjacent to each other, a projecting portion of one of the screen units is positioned above an opening portion of the other of the screen units. At that time, the screen is confined by a clamping portion of the side plate of the screen unit and a projecting portion of a side plate of the subsequent screen unit, so that the screen is not moved. Accordingly, it is possible to perform proper printing at an accurate position with the two screen units being positioned adjacent to each other. Further, operation of cleaning the screens or the like with two screen units being positioned adjacent to each other is effective because it can easily be performed.

In this case, a corner of the side plate should preferably be folded upward. When two screen units are positioned adjacent to each other, one of the screen units gradually increases a contacting area with the other of the screen units. At that time, the screen unit begins to contact the other screen unit at the corner thereof. Therefore, the corner is folded upward to reduce resistance during contacting, so that the screen units can smoothly be positioned adjacent to each other.

According to a preferred aspect of the present invention, the electrostatic printing apparatus is characterized by comprising a cylindrical screen brush for rubbing powdery ink into the screen; and a hopper for supplying powdery ink to the screen brush from a location shifted from a location right above a center of the screen brush toward a rotational direction of the screen brush.

When the powdery ink is distributed onto the screen brush, the distributed powdery ink is non-uniform because of cohesion of the powder. If powdery ink is distributed from right above the screen brush, such non-uniform powdery ink distributed on the screen brush may be rubbed into the screen as it is, thereby producing light and shade of powdery ink attached to the object. With the above arrangement, such a problem is solved because powdery ink is supplied from the position shifted from right above the center of the screen brush toward the rotational direction. Specifically, even if powdery ink to be distributed on the screen brush is non-uniform, because the powdery ink is distributed from the position shifted from right above the center of the screen brush toward the rotational direction, powdery ink hits an outer circumferential surface of the screen brush which has a large inclination angle. Thus, the powdery ink is shattered and dispersed by a rotational force of the screen brush and dropped on the screen before a position at which the powdery ink is rubbed into the screen (i.e. before the printing position). Thus, the powdery ink can be rubbed uniformly into the screen to perform uniform and clean printing.

According to a preferred aspect of the present invention, the electrostatic printing apparatus is characterized by further comprising a screen brush for rubbing powdery ink into the screen; an object detecting sensor for detecting whether or not an object is placed on the carrier conveyer at an upstream side of a printing position; and a brush separation mechanism for separating the screen brush from the screen when the object on the carrier conveyer is positioned at the printing position in a case where it is determined based on a detected result of the object detecting sensor that an object is placed on the carrier conveyer.

If powdery ink is rubbed into the screen while any object is not present at the printing position, the powdery ink scatters below the screen, resulting in not only contamination of the carrier conveyer for transferring objects and the vicinity of carrier devices, but also useless consumption of the powdery ink. Further, if an object is placed on a carrier conveyer that has been contaminated by powdery ink, then a bottom of the object is also contaminated. With the above arrangement, when any object is not placed on a carrier conveyer which is moved to the printing position, the screen brush is separated from the screen. Thus, any powdery ink is not rubbed into the screen. Therefore, it is possible to eliminate contamination of the carrier conveyer and the vicinity of carrier devices and useless consumption of the powdery ink.

According to a preferred aspect of the present invention, the electrostatic printing apparatus is characterized by further comprising an ink recovery device having an abutment piece which is brought into abutment on an upper surface and/or a lower surface of the screen moved by the screen moving mechanism after printing, and a recovery box for recovering powdery ink collected by the abutment piece.

A method of evacuating powdery ink by vacuum has been known as a method of recovering powdery ink which has not used for printing. However, with such a method, because dust in air is also evacuated together with powdery ink, recovered powdery ink cannot be reused, but has to be discarded. Powdery ink which is not used for printing is about 30 percent of the entire powdery ink. Therefore, a large amount of powdery ink becomes useless with a method using vacuum. With the ink recovery device as described above, only powdery ink can readily be recovered. Since impurities such as dust are not contained in the recovered powdery ink, the recovered powdery ink can be reused. Therefore, it is possible to reduce running cost of the apparatus.

According to a fourth aspect of the present invention, there is provided an electrostatic printing apparatus for rubbing powdery ink into a screen having a predetermined printed pattern formed therein, and applying a voltage between the screen and an object so as to attach the powdery ink to the object, the electrostatic printing apparatus characterized by comprising a cylindrical screen brush for rubbing powdery ink into the screen; and a screen brush driving mechanism for rotating the screen brush and moving the screen brush in an axial direction.

According to the printed pattern in the screen, the consumption of the powdery ink may be different from one location to another on the screen. When the powdery ink is rubbed by the screen brush which is also moved in the axial direction, it is possible to spread the powdery ink entirely on the screen even if the consumption of the powdery ink is different from one location to another on the screen. Accordingly, the amount of ink can be made uniform on the screen without a complicated control of the amount of ink to thus achieve uniform and clean printing. Particularly, the screen brush is rotated and moved in the axial direction by one motor. Therefore, mechanisms can be simplified, and manufacturing cost can be reduced. Further, since electric control can be performed by one system, electric circuits for control can also be simplified to reduce manufacturing cost.

According to a fifth aspect of the present invention, there is provided an electrostatic printing apparatus for rubbing powdery ink into a screen having a predetermined printed pattern formed therein, and applying a voltage between the screen and an object so as to attach the powdery ink to the object, the electrostatic printing apparatus characterized by comprising a fixing device having a plurality of heating fins alternately disposed, a heater for heating the heating fins, a temperature sensor for detecting and controlling a temperature of the heater, and an ejection plate including a slit for ejecting heated high-temperature steam to the object, the fixing device bringing steam introduced from a steam introduction port into the heating fins to generate steam having a temperature required to fix the object.

When powdery ink attached onto a surface of an object is to be fixed by steam, if the temperature of the surface of the object is low, steam contacting the surface of the object is lowered in temperature to produce dew. If steam excessively produces dew, the surface of the object becomes so wet that the printed powdery ink flows and cannot be fixed well. In order to prevent such a phenomenon, it is necessary to eject high-temperature steam to a surface of an object for a short period (2 to 5 seconds) to provide moisture and temperature sufficient to cleanly fix powdery ink without flowing on the surface of the object. With the above arrangement, high-temperature steam having temperatures required to fix powdery ink can be ejected from the slit in the ejection plate instantly and continuously. Therefore, the powdery ink does not flow because of moisture and can completely be fixed, so that clean printing is performed.

In order to attain the third through eighth objects of the present invention, according to a sixth aspect of the present invention, there is provided a food producing method characterized by rubbing edible powder into a screen having a predetermined pattern formed therein; applying a voltage between the screen and a food molding receptacle to attach the edible powder onto the food molding receptacle; and introducing a food material to the food molding receptacle onto which the edible powder is attached to form a food.

According to a seventh aspect of the present invention, there is provided a food formed by applying a voltage between a screen having a predetermined pattern formed therein and a food molding receptacle to attach edible powder rubbed into the screen onto the food molding receptacle, and introducing a food material to the food molding receptacle onto which the edible powder is attached.

According to the present invention, it is possible to apply edible powder uniformly and firmly on a side surface or an inclined surface of a recess formed in a food molding receptacle. Particularly, since edible powder can be applied uniformly on a side surface of a recess in a food molding receptacle, which is difficult to have edible powder attached thereto, it is possible to form a food having a complicated shape, which has not been able to be produced. Further, with a screen having a predetermined pattern formed therein, it is possible to apply edible powder only at predetermined portions of an inner surface of a food molding receptacle. Accordingly, useless consumption of edible powder can be reduced, and a food having good appearance can be produced. Since edible powder is not attached to any portions other than required portions, loss can be reduced.

The edible powder includes edible powder containing natural pigment or synthetic pigment, powdery seasoning, and powdery fat and oil. The powdery seasoning includes spice such as capsicum, pepper, and plum, cocoa powder, baking powder, wheat powder, tea powder, sugar powder, sweetener, and general seasoning such as salt, sugar, and soy sauce.

According to an eighth aspect of the present invention, there is provided a food producing method characterized by rubbing powdery seasoning into a screen having a predetermined pattern formed therein; and applying a voltage between the screen and a molded food to attach the powdery seasoning onto the molded food so as to season the molded food.

According to a ninth aspect of the present invention, there is provided a food seasoned by applying a voltage between a screen having a predetermined pattern formed therein and a molded food to attach powdery seasoning rubbed into the screen onto the molded food.

According to the present invention, seasoning such as capsicum, pepper, and plum, which has been difficult to be applied to an object in a conventional method, can firmly and clearly be applied to a surface of a food as powder having a particle diameter of about 5 μm–about 50 μm. Further, by electrostatic printing, edible powder can be applied onto a food which is unlikely to be dried when liquid seasoning, liquid sweetener, or liquid spice is applied to the food, and a food which is likely to be adversely influenced by moisture. A drying process is not necessary, and a food is not adversely influenced because moisture is not added to the food. Further, powdery seasoning can be applied at a final stage after formation of a food or after a heating process. Therefore, there is no influence from heat during processing. Accordingly, it is possible to produce a food without spoiling fresh taste or flavor of powdery seasoning applied to the food. Further, since natural pigment or the like can be applied after food processing, it is possible to produce a clean food without discoloring pigment which is weak to heat during processing or spoiling, flavor.

According to a tenth aspect of the present invention, there is provided a food producing method characterized by rubbing powdery fat and oil into a screen having a predetermined pattern formed therein; and applying a voltage between the screen and a semi-finished food to attach the powdery fat and oil onto the semi-finished food.

According to an eleventh aspect of the present invention, there is provided a food produced by applying a voltage between a screen having a predetermined pattern formed therein and a semi-finished food to attach powdery fat and oil rubbed into the screen onto the semi-finished food.

According to the present invention, since powdery fat and oil can be attached to a semi-finished food, it is possible to produce a deep-fried food readily by a microwave oven in the home. Accordingly, it is not necessary to deep-fry a food in high-temperature oil. Further, since a large amount of powdery fat and oil can be applied, a deep-fried food having unprecedented mouthfeel and taste can be produced by a microwave oven in the home. When a coating is provided around a food sensitive to heat, such as vegetable, and then powdery fat and oil are applied thereto, it is possible to produce a deep-fried food without spoiling the food by heat or changing taste.

According to a twelfth aspect of the present invention, there is provided a food producing method characterized by rubbing edible powder into a screen having a predetermined pattern formed therein; applying a voltage between the screen and an edible sheet to attach the edible powder onto the edible sheet; and placing the edible sheet onto which the edible powder is attached on a food material.

According to a thirteenth aspect of the present invention, there is provided a food produced by applying a voltage between a screen having a predetermined pattern formed therein and an edible sheet to attach edible powder rubbed into the screen onto the edible sheet, and placing the edible sheet onto which the edible powder is attached on a food material.

According to the present invention, since liquid ink is not used, it is not necessary to consider influence of moisture due to ink when a material of an edible sheet to be placed on a food material is selected. Further, edible powder can be printed on an edible sheet in a non-contact manner. Therefore, it is not necessary to enhance strength of the edible sheet, and thus the edible sheet can be made as thin as possible. Therefore, when the edible sheet is placed on a food, the edible sheet is completely melted and disappears, so that the flavor and mouthfeel of the food are not spoiled.

According to a fourteenth aspect of the present invention, there is provided a food producing method characterized by applying an edible adhesive onto a molded food; rubbing edible powder into a screen having a predetermined pattern formed therein; and applying a voltage between the screen and the molded food onto which the edible adhesive is applied to attach the edible powder onto the molded food.

According to a fifteenth aspect of the present invention, there is provided a food produced by applying a voltage between a screen having a predetermined pattern formed therein and a molded food onto which an edible adhesive is applied to attach edible powder rubbed into the screen onto the molded food.

According to the present invention, edible powder having a large particle diameter, which has not heretofore been able to be attached, can firmly be attached onto a surface of a molded food. Further, fibrous edible powder can be applied on a surface of a molded food so as to project upward, so that a food having good appearance and mouthfeel can be produced.

According to a sixteenth aspect of the present invention, there is provided a food producing method characterized by rubbing edible powder into a screen having a predetermined pattern formed therein; and applying a voltage between the screen and a process plate to accumulate the edible powder on a surface of the process plate to form a food made of the edible powder.

According to a seventeenth aspect of the present invention, there is provided a food formed by applying a voltage between a screen having a predetermined pattern formed therein and a process plate to accumulate the edible powder rubbed into the screen on a surface of the process plate.

According to the present invention, even those who are not skilled can readily produce a food having a complicated shape by an unprecedented method.

BEST MODE FOR CARRYING OUT THE INVENTION

An electrostatic printing apparatus according to embodiments of the present invention will be described below with reference to the drawings.

Figure 1:
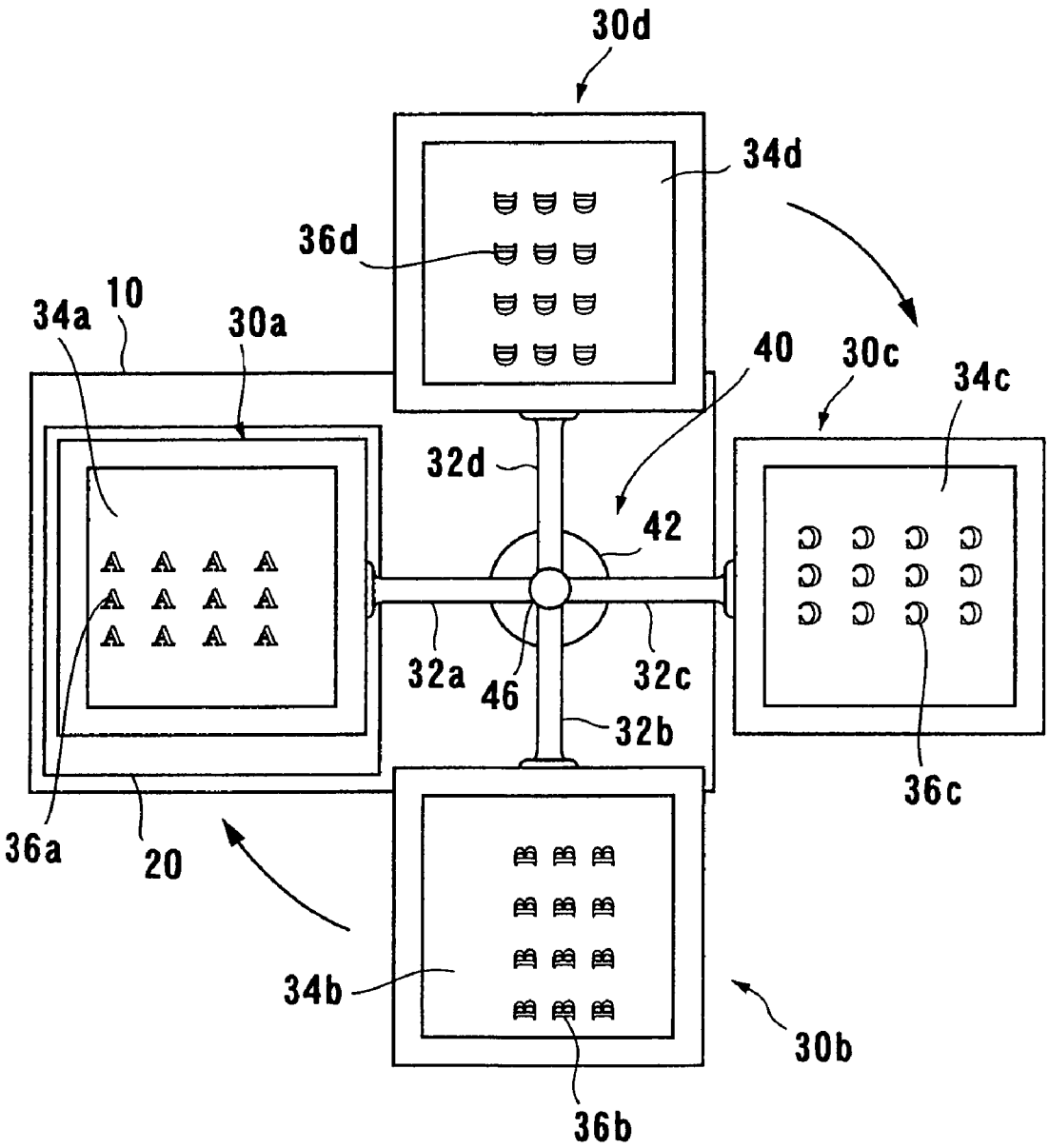
FIG. 1 is a plan view showing an electrostatic printing apparatus according to a first embodiment of the present invention.
Figure 2:
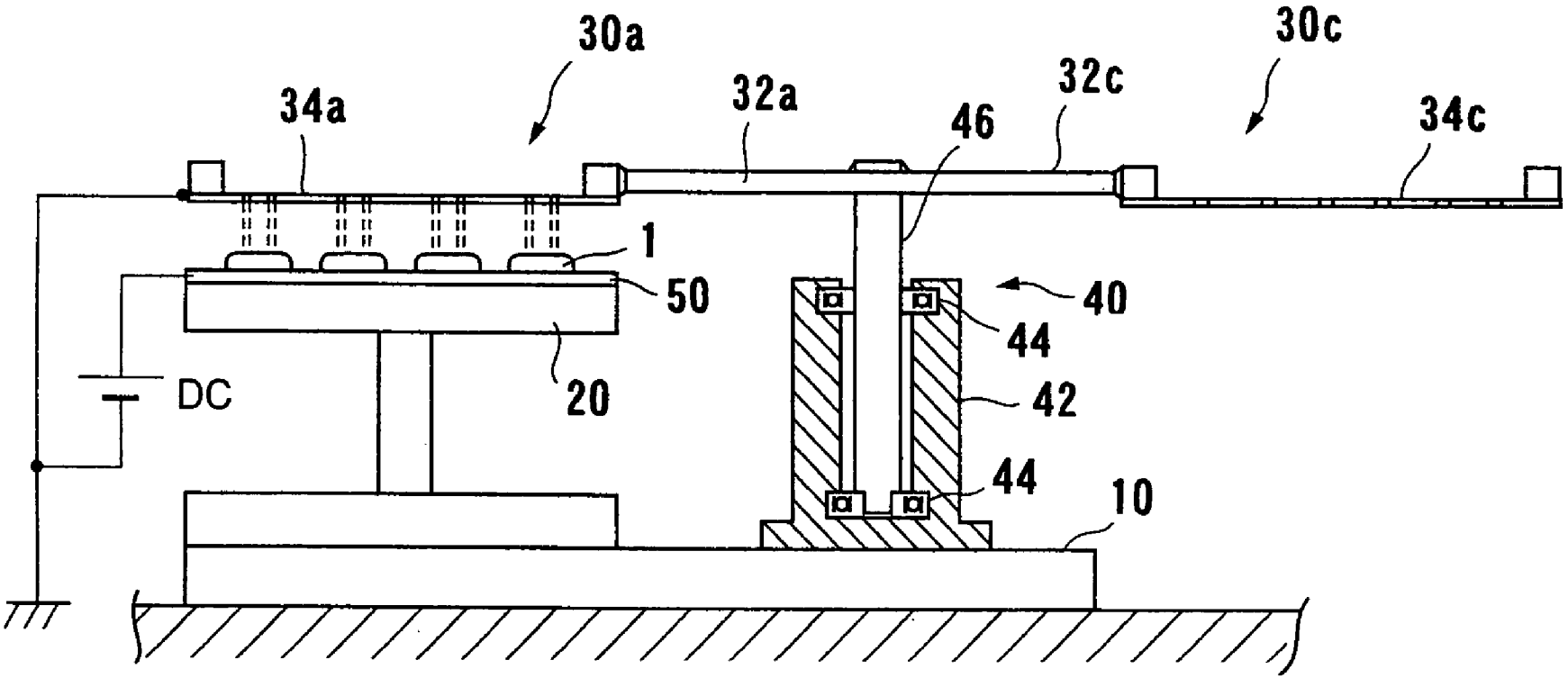
FIG. 2 is a vertical cross-sectional view of FIG. 1.

FIG. 1 is a plan view showing an electrostatic printing apparatus according to a first embodiment of the present invention, and FIG. 2 is a vertical cross-sectional view of FIG. 1. The electrostatic printing apparatus in the present embodiment has a base 10 in the form of a flat plate, a mounting stage 20 fixedly disposed on the base 10 in the form of a flat plate, and a rotation unit 40 for rotating screen units 30*a*–30*d*. Objects 1 such as confectioneries are arranged in a pallet 50 made of metal and mounted on the mounting stage 20. The mounting stage 20 is connected to a direct-current power supply DC.

The rotation unit 40 has a rotation cylinder 42 fixed to the base 10 and a shaft 46 supported via bearings 44 by the rotation cylinder 42. Four screen units 30*a*–30*d* are attached to an upper end of the shaft 46. Each of the screen units 30*a*–30*d* comprises a rotation arm 32*a*–32*d* horizontally extending from the upper end of the shaft 46 and a stencil screen 34*a*–34*d* attached to the rotation arm 32*a*–32*d*. With such an arrangement, the stencil screens 34*a*–34*d* are rotatable about the shaft 46.

The stencil screens 34*a*–34*d* are made of a conductive material, and printed patterns including characters and figures are formed of meshes 36*a*–36*d* on the stencil screens 34*a*–34*d*. The stencil screens 34*a*–34*d* have a ground potential. When printing is performed, powdery ink is applied onto an upper surface of the stencil screen and rubbed into the stencil screen by a urethane sponge brush or the like. As the powdery ink, it is possible to use various kinds of powder, such as edible ink containing natural pigment or synthetic pigment, cocoa powder, wheat powder, tea powder, sugar powder, and industrial powdery ink, according to an intended use. Objects 1 used in an electrostatic printing apparatus according to the present invention are not limited to a food such as confectionery and may comprise industrial goods.

In the present embodiment, powdery ink having different colors is applied onto and rubbed into the four stencil screens 34*a*–34*d*, respectively. Thus, the electrostatic printing apparatus in the present embodiment serves as an electrostatic printing apparatus for four-colored printing. Different types of powdery ink may be applied onto and rubbed into the respective stencil screens 34*a*–34*d* so as to serve as an electrostatic printing apparatus for four-type printing.

There will be described operation of the electrostatic printing apparatus thus constructed when objects 1 are printed by the electrostatic printing apparatus.

First, objects 1 such as confectioneries are arranged in a recess of the pallet 50, and the pallet 50 having the objects 1 placed thereon is placed on the mounting stage 20. Then, the screen unit 30*a* is rotated so that the stencil screen 34*a* for a first color is positioned above the mounting stage 20. FIG. 1 shows this state. For example, the mounting stage 20 may have a positioning mechanism which can engage with the rotation arms 32*a*–32*d* in order to position the stencil screen accurately.

After the stencil screen 34*a* for a first color is positioned above the mounting stage 20, powdery ink having a first color is applied onto an upper surface of the stencil screen 34*a* and rubbed into the stencil screen 34*a* by a urethane sponge brush or the like. At that time, a high direct-current voltage, e.g. a high voltage of 5000 to 6000 V, is applied between the stencil screen 34*a*, and the mounting stage 20 by the direct-current power supply DC to form an electrostatic field between the stencil screen 34*a* and the mounting stage 20. The powdery ink that has been rubbed into the stencil screen 34*a* is pushed out downwardly through the mesh 36*a* in the stencil screen 34*a*. The powdery ink that has passed through the mesh 36*a* and has thus been charged is accelerated toward the mounting stage 20, which serves as a counter electrode, i.e., the objects 1. Accordingly, the powdery ink having the first color is attached onto the objects 1. Thus, printing of the first color is completed.

After printing of the first color is completed, the application of the high direct-current voltage by the direct-current power supply DC is interrupted, and the screen unit 30*b* is rotated so that the stencil screen 34*b* for a second color is positioned above the mounting stage 20. Then, as described above, powdery ink having a second color is applied onto an upper surface of the stencil screen 34*b* and rubbed into the stencil screen 34*b*. At that time, a high direct-current voltage is applied between the stencil screen 34*b* and the mounting stage 20 by the direct-current power supply DC to attach the powdery ink having the second color onto the objects 1. Thus, printing of the second color is completed.

With regard to printing of a third color and a fourth color, the same operation as described above is performed with the stencil screen 34*c* for a third color and the stencil screen 34*d* for a fourth color. Thus, four-colored printing can be performed on the objects 1. In the present embodiment, there has been described an electrostatic printing apparatus for performing four-colored printing with four stencil screens 34*a*–34*d*. However, the number of the stencil screens may be changed to perform multicolored printing of a desired number of colors.

As described above, according to an electrostatic printing apparatus of the present invention, multicolored printing can be achieved by only one electrostatic printing apparatus. Therefore, a space for installation can be reduced to achieve a compact arrangement. Further, the apparatus requires only one high-voltage direct-current power supply and one device for various purposes. Therefore, cost to perform multicolored printing can remarkably be reduced.

Further, multicolored printing can be achieved by powdery ink having different colors in a state such that the objects 1 remain stationary on the mounting stage 20. Therefore, printing positions are not different according to colors, and hence accurate and clean printing can be achieved on the objects 1.

Figure 3:
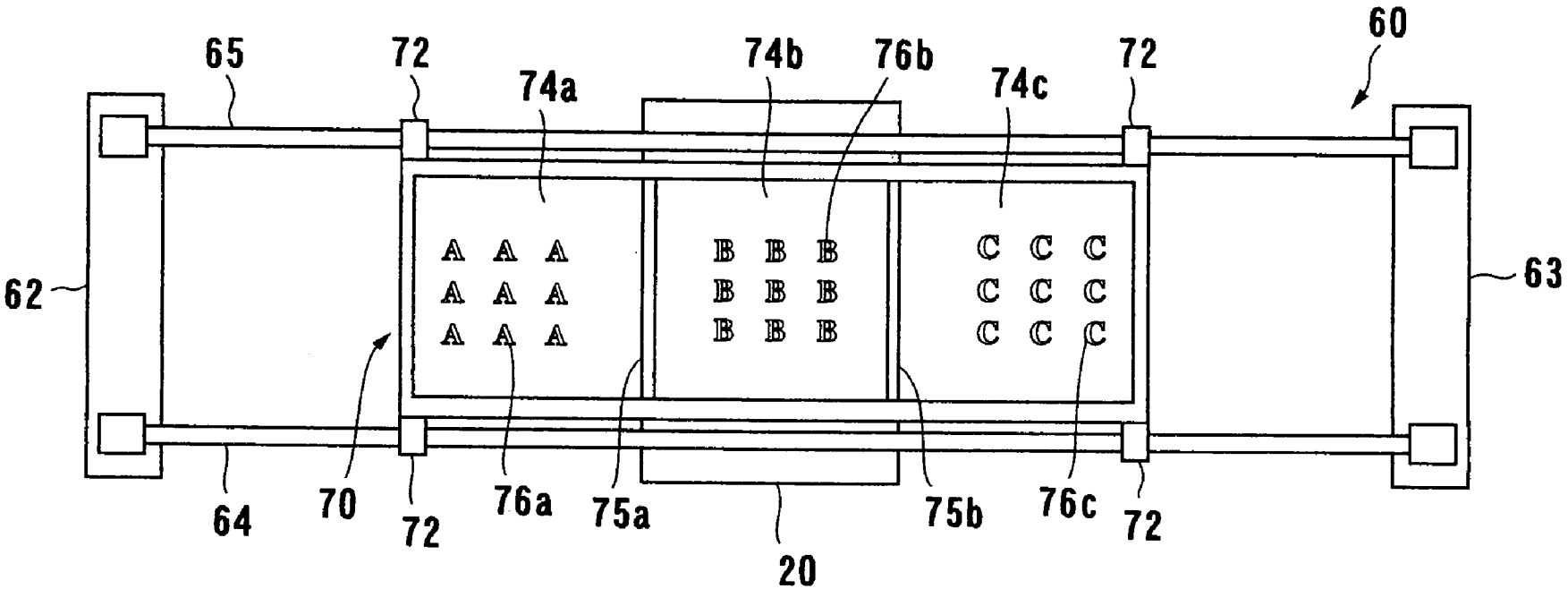
FIG. 3 is a plan view showing an electrostatic printing apparatus according to a second embodiment of the present invention.
Figure 4:
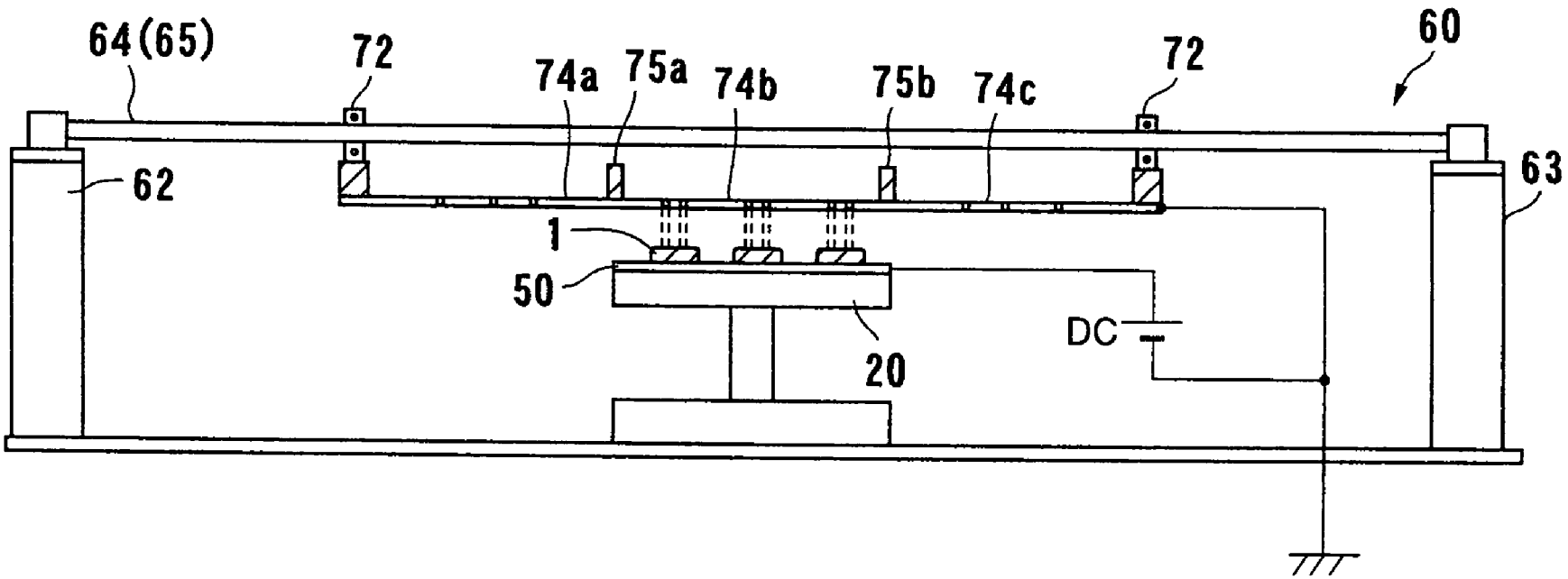
FIG. 4 is a vertical cross-sectional view of FIG. 3.

FIG. 3 is a plan view showing an electrostatic printing apparatus according to a second embodiment of the present invention, FIG. 4 is a vertical cross-sectional view of FIG. 3. Components or elements having the same effects and functions as those in the first embodiment are designated by the same reference numbers as in the first embodiment, and the details are the same as in the first embodiment unless otherwise described.

The electrostatic printing apparatus in the present embodiment has a sliding movement unit 60 disposed over a mounting stage 20. The sliding movement unit 60 comprises two poles 62 and 63 interposing the mounting stage 20 therebetween, and two rails 64 and 65 extending between the two poles 62 and 63. A screen unit 70 is supported via bearings by the rails 64 and 65 so as to be horizontally movable.

The screen unit 70 has three stencil screens 74*a*–74*c*, which are partitioned by partition plates 75*a* and 75*b*. As with the first embodiment, the stencil screens 74*a*–74*c* are made of a conductive material, and printed patterns including characters and figures are formed of meshes 76*a*–76*c* on the stencil screens 74*a*–74*c*. The stencil screens 74*a*–74*c* have a ground potential.

In the present embodiment, powdery ink having different colors are applied onto and rubbed into three stencil screens 74*a*–74*c*. Thus, the electrostatic printing apparatus in the present embodiment serves as an electrostatic printing apparatus for three-colored printing. Different types of powdery ink may be applied onto and rubbed into the respective stencil screens 74*a*–74*c* so as to serve as an electrostatic printing apparatus for multi-type printing.

There will be described operation of the electrostatic printing apparatus thus constructed when objects 1 are printed by the electrostatic printing apparatus.

As with the first embodiment, a pallet 50 having objects 1 placed thereon is placed on the mounting stage 20. Thereafter, the screen unit 70 is horizontally moved so that the stencil screen 74*a* for a first color is positioned above the mounting stage 20. Then, powdery ink having a first color is applied onto an upper surface of the stencil screen 74*a* and rubbed into the stencil screen 74*a* by a urethane sponge brush or the like. At that time, a high direct-current voltage, e.g. a high voltage of 5000 to 6000 V, is applied between the stencil screen 74*a* and the mounting stage 20 by the direct-current power supply DC to form an electrostatic field between the stencil screen 74*a* and the mounting stage 20. The powdery ink that has been rubbed into the stencil screen 74*a* is pushed out downwardly through the mesh 76*a* formed in the stencil screen 74*a*. The powdery ink that has passed through the mesh 76*a* and has thus been charged is accelerated toward the mounting stage 20, which serves as a counter electrode, i.e., the objects 1. Accordingly, the powdery ink having the first color is attached onto the objects 1. Thus, printing of the first color is completed.

After printing of the first color is completed, the application of the high direct-current voltage by the direct-current power supply DC is interrupted, and the screen unit 70 is horizontally moved so that the stencil screen 74*b* for a second color is positioned above the mounting stage 20. FIG. 3 shows this state. Then, as described above, powdery ink having a second color is applied onto an upper surface of the stencil screen 74*b* and rubbed into the stencil screen 74*b*. At that time, a high direct-current voltage is applied between the stencil screen 74*b* and the mounting stage 20 by the direct-current power supply DC to attach the powdery ink having the second color onto the objects 1. Thus, printing of the second color is completed.

With regard to printing of a third color, the same operation as described above is performed with the stencil screen 74*c* for a third color. Thus, three-colored printing can be performed on the objects 1. In the present embodiment, there has been described an electrostatic printing apparatus for performing three-colored printing with three stencil screens 74*a*–74*c*. However, the number of the stencil screens may be changed so as to perform multicolored printing with a desired number of colors.

As described above, according to an electrostatic printing apparatus of the present invention, multicolored printing can be achieved by only one electrostatic printing apparatus. Therefore, a space for installation can be reduced to achieve a compact arrangement. Further, the apparatus requires only one high-voltage direct-current power supply and one device for various purposes. Therefore, cost to perform multicolored printing can remarkably be reduced.

Further, multicolored printing can be achieved by powdery ink having different colors in a state such that the objects 1 remain stationary on the mounting stage 20. Therefore, printing positions are not different according to colors, and hence accurate and clean printing can be achieved on the objects 1.

In the first and second embodiments, there has been described an example in which the stencil screens have a ground potential. The present invention is not limited to these examples. The direct-current power supply may be connected to the stencil screens so that the mounting stage has a ground potential.

Figure 5:
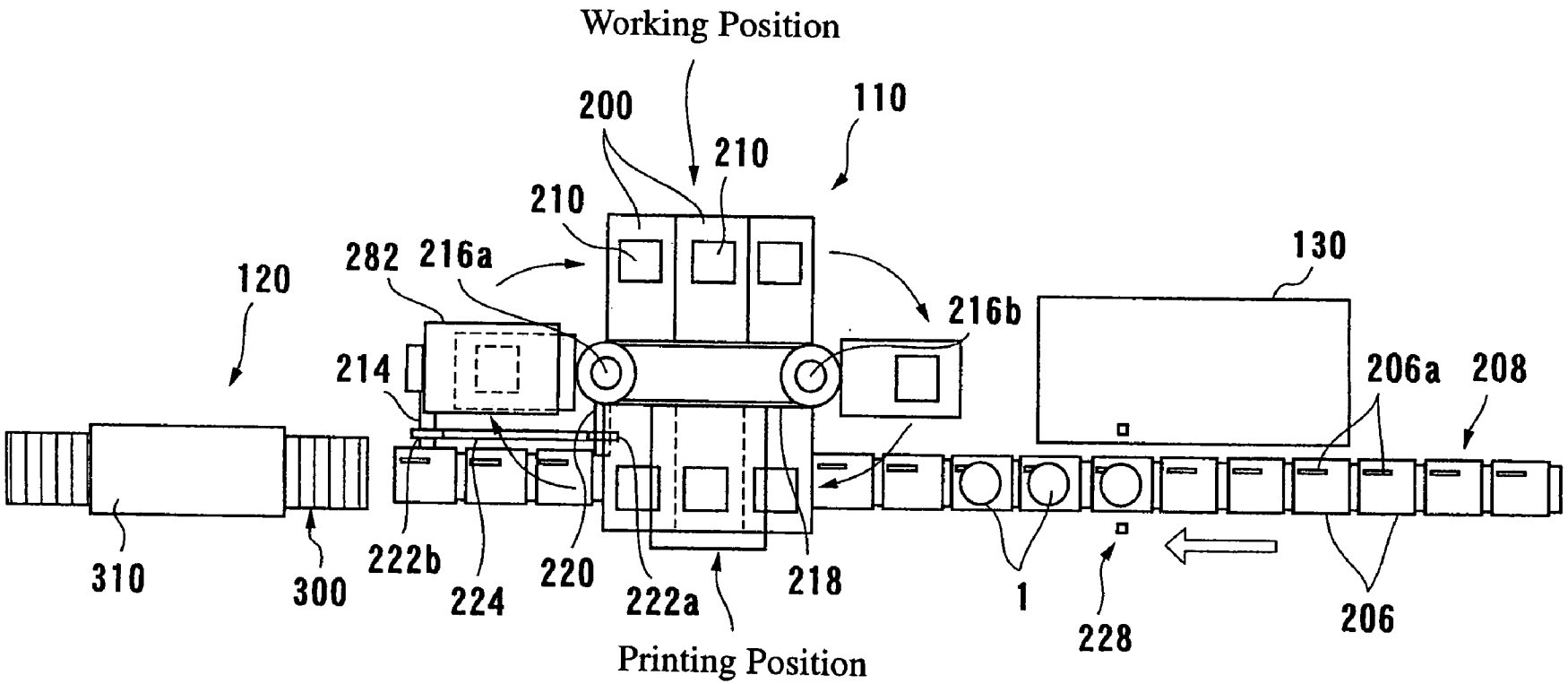
FIG. 5 is a schematic plan view showing an electrostatic printing apparatus according to a third embodiment of the present invention.

Next, an electrostatic printing apparatus according to a third embodiment of the present invention will be described below in detail with reference to FIGS. 5 through 12. FIG. 5 is a schematic plan view showing an electrostatic printing apparatus according to the third embodiment of the present invention, and FIG. 6 is a front view of FIG. 5.

Figure 6:
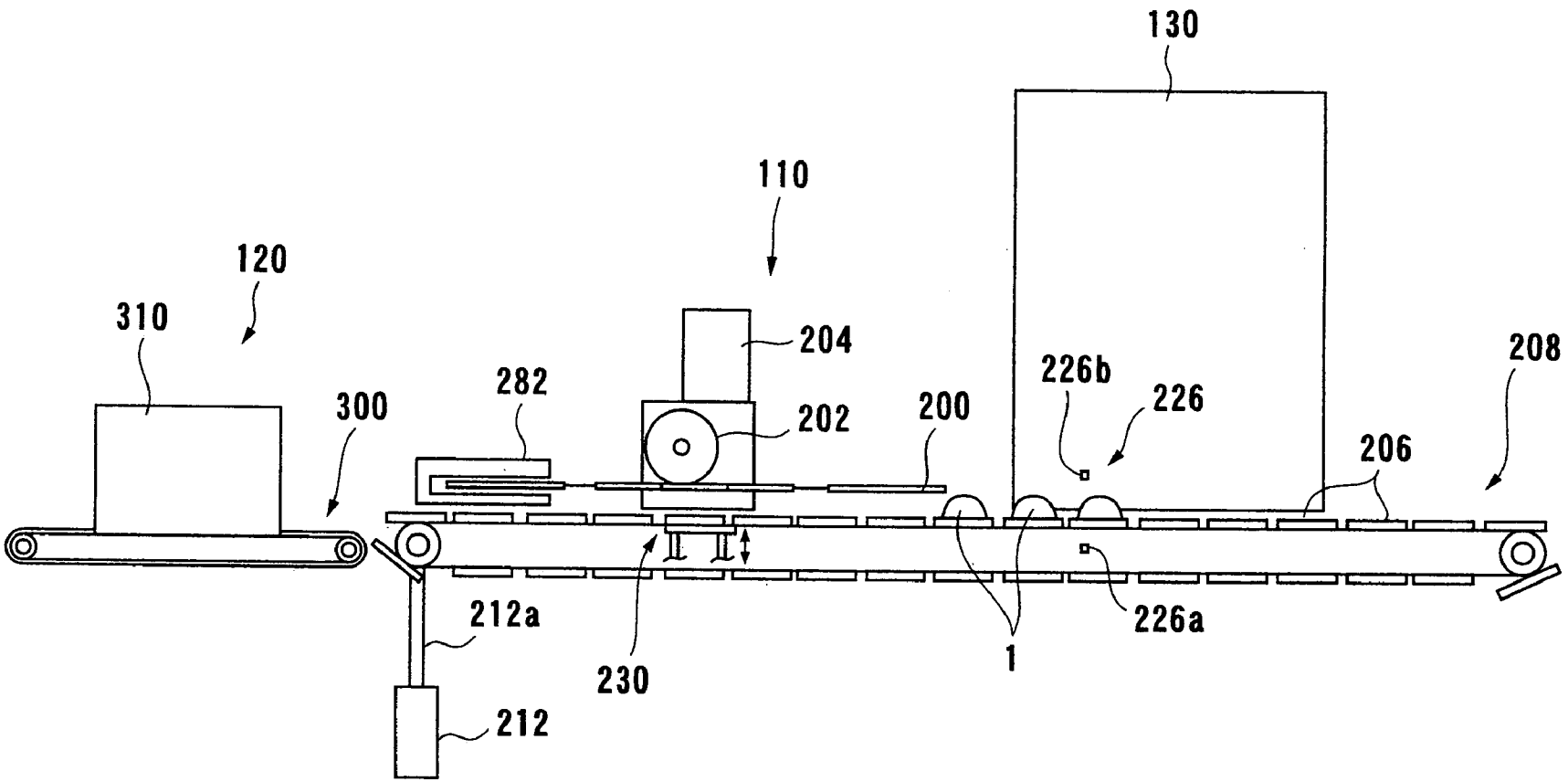
FIG. 6 is a front view of FIG. 5.

As shown in FIGS. 5 and 6, the electrostatic printing apparatus in the present embodiment has a printing section 110 for attaching powdery ink onto a surface of an object 1 such as confectionery or bread, a fixing section 120 for fixing the powdery ink attached onto the surface of the object 1, and a controlling section 130 for controlling each section. The object 1 is not limited to a food such as confectionery and may comprise industrial goods. As the powdery ink, it is possible to use various kinds of powder, such as edible ink containing natural pigment or synthetic pigment, cocoa powder, wheat powder, tea powder, sugar powder, and industrial powdery ink, according to an intended use.

The printing section 110 has a plurality of screen units 200 in the form of a flat plate, a cylindrical screen brush 202 disposed above the screen unit 200 positioned at a printing position, a hopper 204 disposed above the screen brush 202, and a carrier conveyer 208 for transferring carrier pallets 206 on which objects 1 are placed. The fixing section 120 has a carrier conveyer 300 for transferring objects 1 onto which powdery ink is attached in the printing section 110, and a fixing device 310 for fixing the powdery ink attached onto the objects 1.

Each of the screen units 200 in the printing section 110 has a stencil screen 210 made of a conductive material, and a printed pattern including characters and figures is formed of mesh on the stencil screen 210. In the present embodiment, eight screen units 200 are provided in the printing section 110. The hopper 204 serves to supply powdery ink to the screen brush 202. The screen brush 202 serves to rub powdery ink supplied from the hopper 204 into the screen 210 of the screen unit 200.

An object 1 placed on the carrier pallet 206 is transferred to the printing position by the carrier conveyer 208. At that time, a high direct-current voltage, e.g. a high voltage of 5000 to 6000 V, is applied between the screen 210 of the screen unit 200 and the carrier pallet 206 to form an electrostatic field between the screen 210 and the carrier pallet 206. Powdery ink is rubbed into the screen 210 by the screen brush 202. The powdery ink that has passed through the mesh and has thus been charged is accelerated toward the carrier pallet 206, which serves as a counter electrode, by the electrostatic field and attached to the object 1 on the carrier pallet 206. The object 1 onto which the powdery ink has been attached is transferred from the carrier conveyer 208 in the printing section 110 to the carrier conveyer 300 in the fixing section 120 and then passes through the fixing device 310 in the fixing section 120. In the fixing device 310, the object 1 is heated by high-temperature steam, and the powdery ink attached onto the surface of the object 1 is fixed by heating.

The carrier conveyer 208 in the printing section 110 has a plurality of carrier pallets 206 mounted thereon consecutively in a transferring direction. Objects 1 are placed on these carrier pallets 206. A driving motor 212 is provided below the carrier conveyer 208, and an output shaft 212*a* of the driving motor 212 is coupled through a miter gear (not shown) to a driving shaft 214 of the carrier conveyer 208.

The respective screen units 200 in the printing section 110 are attached to a carrier chain 218 mounted between two sprockets 216*a* and 216*b*. One of the sprockets 216*a* is coupled through a miter gear (not shown) to a driven shaft 220. The driven shaft 220 and the driving shaft 214 of the carrier conveyer 208 have sprockets 222*a* and 222*b*, respectively, and a chain 224 is mounted between the sprockets 222*a* and 222*b*.

When the driving motor 212 is operated, rotation of the driving motor 212 is transmitted to the driving shaft 214 of the carrier conveyer 208 and also to the sprockets 222*a* and 216*a* through the chain 224 connected to the sprocket 222*b* on the driving shaft 214. Therefore, when the driving motor 212 is rotated, the carrier conveyer 208 is driven, and the sprocket 216*a* is rotated to move the screen units 200 so as to trace an elliptic orbit as shown in FIG. 5. Thus, in the present embodiment, the driving motor 212, the driving shaft 214, the sprockets 216*a*, 216*b*, 222*a*, 222*b*, the chains 218, 224, and the driven shaft 220 form a screen moving mechanism for moving the screens 210 to a position located above the object 1, which is moved by the carrier conveyer 208.

The rotation of the driving shaft 214 of the carrier conveyer 208 and the rotation of the sprocket 216a are synchronized with each other so that a moving speed of the carrier pallets 206 by the carrier conveyer 208 is equal to a moving speed of the screen units 200. Thus, in the present embodiment, the screen moving mechanism and the carrier conveyer 208 form a synchronizing mechanism for synchronizing the moving speed of the objects 1 by the carrier conveyer 208 and the moving speed of the screens 210 by the screen moving mechanism. In this case, the moving speed of the objects 1 by the carrier conveyer 208 and the moving speed of the screens 210 by the screen moving mechanism may be synchronized with each other while a ratio thereof is being adjusted. In such a case, patterns to be printed on the objects 1 can be expanded or contracted in the moving direction.

As described above, the respective screen units 200 are moved so as to trace the elliptic orbit. As shown in FIG. 5, when the screen unit 200 is positioned at the printing position, it is brought into abutment on the previous and subsequent screen units 200. After printing is performed at the printing position, the screen unit 200 is separated from the previous and subsequent screen units (this position is hereinafter referred to as a first intermediate position) and brought into abutment on the previous and subsequent screen units at a position opposite to the printing position (this position is hereinafter referred to as a working position). Then, the screen unit 200 is separated from the previous and subsequent screen units (this position is hereinafter referred to as a second intermediate position) and brought into abutment on the previous and subsequent screen units at the printing position.

An object detecting sensor 226 is disposed at the upstream side of the printing position, i.e. at the upstream side of the carrier conveyer 208 in a traveling direction, so as to interpose the carrier pallet 206 located on an upper surface of the carrier conveyer 208. The object detecting sensor 226 employs an optical sensor including a light-emitting element 226*a* and a light-receiving element 226*b*. As shown in FIG. 5, each of the carrier pallets 206 has a light-transmissive hole 206*a* formed therein for allowing light emitted from the light-emitting element 226*a* of the optical sensor to pass therethrough. When any object 1 is not placed on a carrier pallet 206, light emitted from the light-emitting element 226*a* passes through the light-transmissive hole 206*a* in the carrier pallet 206 and is received by the light-receiving element 226*b*, which determines that any object 1 is not placed on the carrier pallet 206. On the other hand, when an object 1 is placed on the carrier pallet 206, light emitted from the light-emitting element 226*a* is blocked by the object 1 on the carrier pallet 206 and is not received by the light-receiving element 226*b*, which determines that an object 1 is placed on the carrier pallet 206. Output signals from the object detecting sensor 226 are transmitted to the controlling section 130.

A height detecting sensor 228 for detecting heights of objects 1 placed on the carrier pallets 206 is also provided at the upstream side of the printing position. As with the aforementioned object detecting sensor 226, the height detecting sensor 228 is formed by an optical sensor. Output signals from the height detecting sensor 228 are transmitted to the controlling section 130.

The printing position has a lifter 230 for vertically moving a carrier rail of the carrier conveyer 208. When the carrier rail is lifted by the lifter 230, the carrier pallets 206 on the carrier conveyer 208 are also lifted. In view of performing clear printing, it is ideal that a distance between a surface of an object 1 to be printed and the screen 210 (this distance is hereinafter referred to as a printing distance) should be a minimum distance such that electric discharge is not developed between the object 1 and the screen 210. The heights of the objects 1 differ depending on the objects 1. If a distance between the carrier pallet 206 and the screen 210 is fixed at a constant value, optimal printing distances cannot be obtained for each object 1. Therefore, in the present embodiment, the heights of the respective objects 1 are detected by the height detecting sensor 228, and a lifting distance of the lifter 230 is adjusted based on the outputs from the height detecting sensor 228 to achieve optimal printing distances according to the heights of the respective objects 1. Thus, the electrostatic printing apparatus according to the present invention can perform clear and clean printing even if the respective objects 1 have different heights.

Figure 7A:
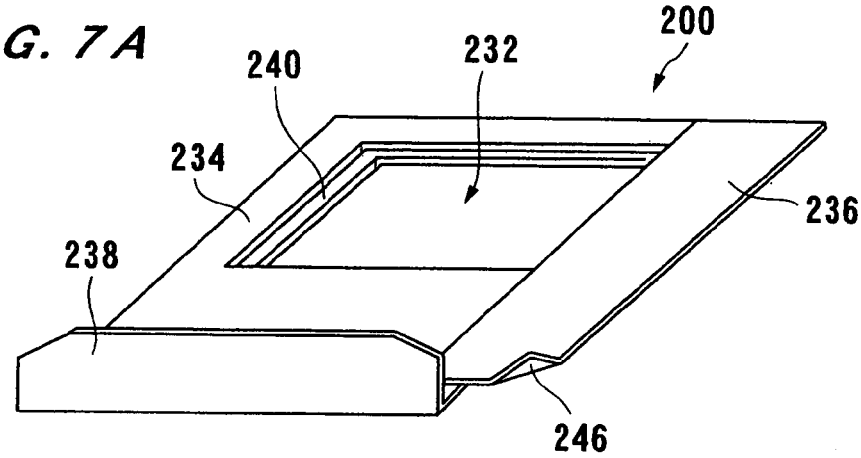
FIG. 7A is a perspective view showing a screen unit according to an embodiment of the present invention.
Figure 7B:
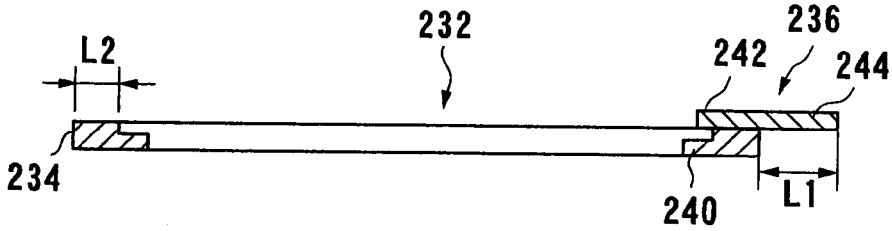
FIG. 7B is a front cross-sectional view of FIG. 7A.
Figure 7C:
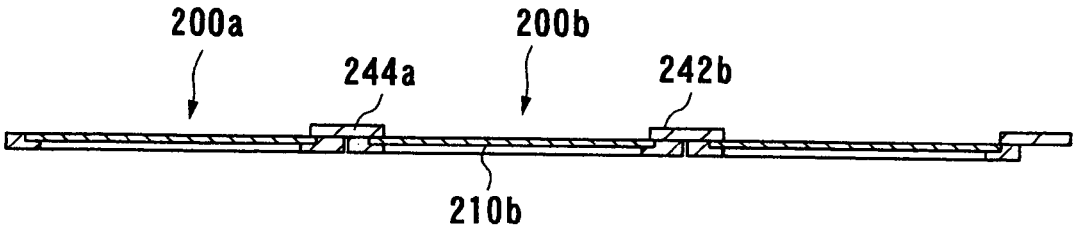
FIG. 7C is a cross-sectional view showing screen units at a printing position.

FIG. 7A is a perspective view showing the screen unit 200, from which the screen 210 is removed, FIG. 7B is a front cross-sectional view of FIG. 7A, and FIG. 7C is a cross-sectional view showing the screen units 200 at the printing position. As shown in FIGS. 7A and 7B, the screen unit 200 in the present embodiment has a flat plate 234 having a rectangular opening portion 232, a side plate 236 mounted on an upper surface of a lateral portion of the flat plate 234 in a moving direction of the screen unit, and an attachment plate 238 to be attached to the carrier chain 218. The flat plate 234 has a screen supporting portion 240 provided at a lower portion of the opening portion 232 for supporting the screen 210.

As shown in FIG. 7B, the side plate 236 has a clamping portion 242 extending in the moving direction of the screen unit 200 from above the screen supporting portion 240 of the flat plate 234 and being located above the screen supporting portion 240, and a projecting portion 244 projecting from the lateral portion of the flat plate 234. The screen 210 is disposed in the opening portion 232 of the flat plate 234 in a state such that one edge of the screen 210 is clamped between the screen supporting portion 240 of the flat plate 234 and the clamping portion 242 of the side plate 236.

As shown in FIG. 7B, the length L1 of the projecting portion 244 of the side plate 236 is longer than the length L2 from an edge of the flat plate to the opening portion 232. Therefore, when two screen units are positioned adjacent to each other, a projecting portion 244 of a subsequent screen unit is positioned above an opening portion 232 of a previous screen unit. With such an arrangement, as shown in FIG. 7C, when a screen unit 200*b* is moved to the printing position, a screen 210*b* is confined by a clamping portion 242*b* of the screen unit 200*b* and a projecting portion 244*a* of a subsequent screen unit 200*a*. Thus, the screen 210*b* is not moved when powdery ink is rubbed by the screen brush 202. Accordingly, it is possible to perform proper printing at an accurate position. Similarly, the screen 210 is not moved within the screen unit 200 at the working position. Therefore, operation of cleaning the screens 210 or the like at the working position is effective because it can easily be performed.

As shown in FIG. 7A, the side plate 236 has a corner 246 folded upward on a side of the attachment plate 238. During the movement of the screen unit 200 on the elliptic orbit, the screen unit 200 gradually increases a contacting area with a previous screen unit 200 when the screen unit 200 is moved from the second intermediate position to the printing position or from the first intermediate position to the working position, and is finally brought into abutment on the previous screen unit 200 at the printing position or the working position. At that time, the screen unit 200 begins to contact the previous screen unit 200 at the corner 246. Therefore, the corner 246 is folded upward to reduce resistance during contacting, so that the screen units 200 can smoothly be positioned adjacent to each other.

Figure 8:
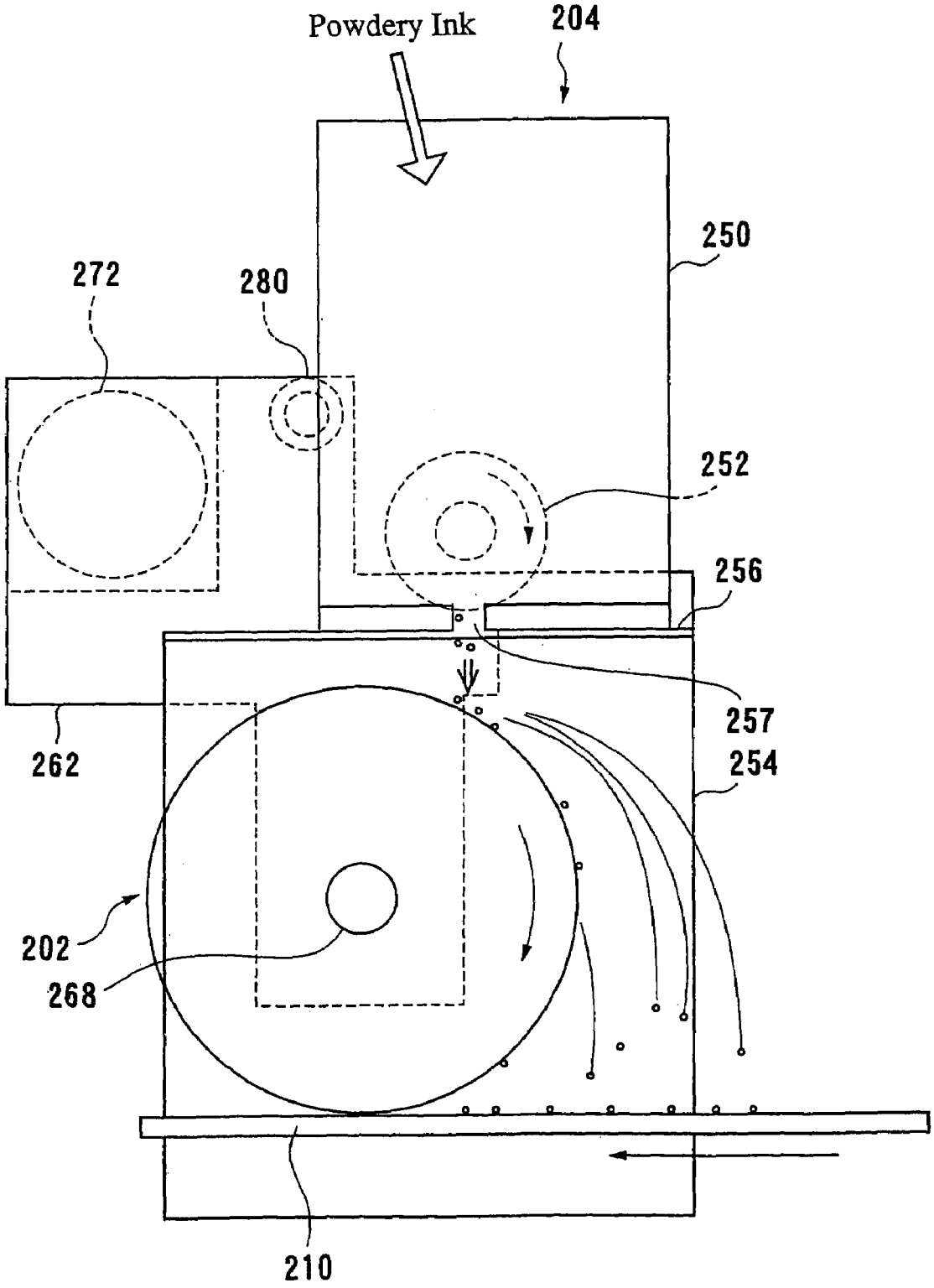
FIG. 8 is a front cross-sectional view near the printing position in a printing section shown in FIG. 5.
Figure 9:
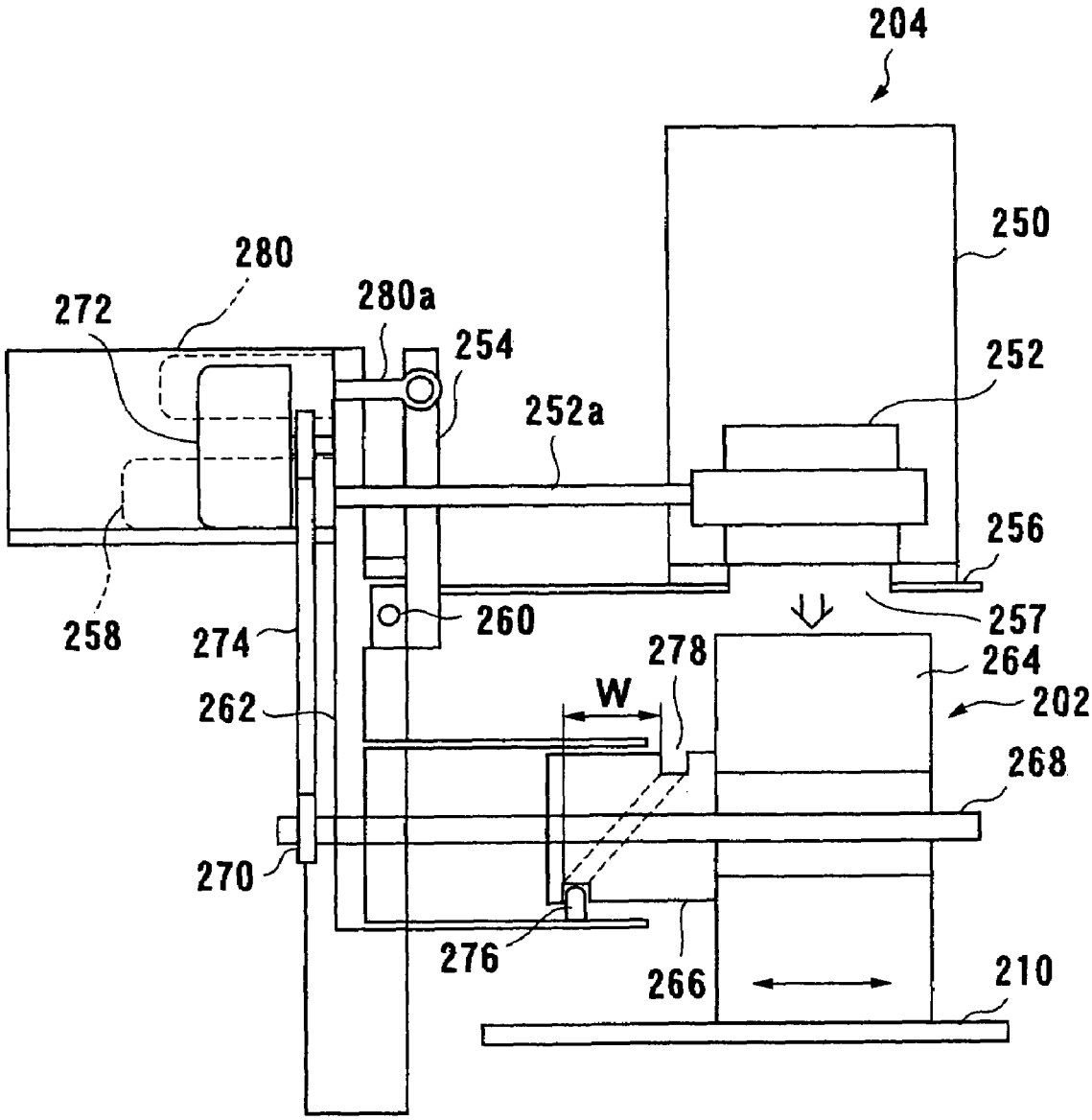
FIG. 9 is a side cross-sectional view near the printing position in the printing section shown in FIG. 5.

FIG. 8 is a front cross-sectional view near the printing position in the printing section 110 shown in FIG. 5, and FIG. 9 is a side cross-sectional view thereof. As shown in FIGS. 8 and 9, the hopper 204 has a hopper container 250 housing powdery ink, a hopper brush 252 disposed within the hopper container 250, and a hopper container supporting portion 256 mounted on a stationary frame 254. Powdery ink to be supplied to the screen brush 202 is introduced from above the hopper container 250. Distributing holes 257 for distributing the introduced powdery ink onto the screen brush 202 are formed in a bottom of the hopper container 250 and the hopper container supporting portion 256. Further, a hopper brush rotation motor 258 for rotating the hopper brush 252 is provided on the stationary frame 254, and a rotational shaft 252*a* of the hopper brush 252 is coupled to the hopper brush rotation motor 258. When the hopper brush 252 is rotated by operation of the hopper brush rotation motor 258, the powdery ink introduced into the hopper container 250 is distributed through the distributing holes 257 onto the screen brush 202.

As shown in FIG. 8, the aforementioned distributing holes 257 is not positioned right above the center of the screen brush 202, but is positioned at a position shifted from the center of the screen brush 202 toward the rotational direction. When the powdery ink is distributed onto the screen brush 202, the distributed powdery ink is non-uniform because of cohesion of the powder. If powdery ink is distributed from right above the screen brush 202, such non-uniform powdery ink distributed on the screen brush 202 may be rubbed into the screen 210 as it is, thereby producing light and shade of powdery ink attached to the object 1. In the present embodiment, such a problem is solved because powdery ink is supplied from the position shifted from right above the center of the screen brush 202 toward the rotational direction as described above. Specifically, even if powdery ink to be distributed on the screen brush 202 is non-uniform, because the powdery ink is distributed from the position shifted from right above the center of the screen brush 202 toward the rotational direction, powdery ink dropped from the distributing holes 257 hits an outer circumferential surface of the screen brush 202 which has a large inclination angle. Thus, the powdery ink is shattered and dispersed by a rotational force of the screen brush 202 and dropped on the screen 210 before a position at which the powdery ink is rubbed into the screen 210 (i.e. before the printing position). Thus, the powdery ink can be rubbed uniformly into the screen 210 to perform uniform and clean printing.

As shown in FIG. 9, a movable frame 262 rotatable about a spindle 260 is attached to the stationary frame 254. The screen brush 202 is attached to a lower portion of the movable frame 262. The screen brush 202 has a urethane sponge 264, a slidable cylinder 266 to which the urethane sponge 264 is attached, and a spline shaft 268 disposed inside the slidable cylinder 266. In a state shown in FIG. 9, the urethane sponge 264 of the screen brush 202 is brought into contact with the screen 210. The slidable cylinder 266 is slidable in an axial direction of the spline shaft 268 through bearings and is rotatable together with the spline shaft 268 by engagement of a key (not shown) provided on the slidable cylinder 266 with a key groove (not shown).

The spline shaft 268 of the screen brush 202 is mounted on the movable frame 262, and a sprocket 270 is provided at an end of the spline shaft 268. A screen brush rotation motor 272 for rotating a screen brush 202 is provided at an upper portion of the movable frame 262. The sprocket 270 of the spline shaft 268 is coupled via a chain 274 to the screen brush rotation motor 272. The spline shaft 268 of the screen brush 202 is rotated by operation of the screen brush rotation motor 272.

The slidable cylinder 266 of the screen brush 202 has a cam groove 278 formed therein which is engaged with a cam 276 fixed to the movable frame 262. Therefore, when the spline shaft 268 is rotated by operation of the screen brush rotation motor 272, the slidable cylinder 266 is rotated together with the spline shaft 268 and simultaneously reciprocated in the axial direction by the engagement of the cam 276. Thus, in the present embodiment, the slidable cylinder 266, the spline shaft 268, the sprocket 270, the screen brush rotation motor 272, the chain 274, and the cam 276 form a screen brush driving mechanism for rotating the screen brush 202 and simultaneously moving the screen brush 202 in the axial direction.

According to the printed pattern in the screen 210, the consumption of the powdery ink may be different from one location to another on the screen 210. When the powdery ink is rubbed by the screen brush 202 which is also moved in the axial direction, it is possible to spread the powdery ink entirely on the screen 210 even if the consumption of the powdery ink is different from one location to another on the screen 210. Accordingly, the amount of ink can be made uniform on the screen 210 without a complicated control of the amount of ink to thus achieve uniform and clean printing. Particularly, in the present embodiment, the screen brush 202 is rotated and moved in the axial direction by one motor. Therefore, mechanisms can be simplified, and manufacturing cost can be reduced. Further, since electric control can be performed by one system, electric circuits for control can also be simplified to reduce manufacturing cost. The width W of movement in the axial direction should preferably be designed such that the screen brush is moved from locations where the consumption of the powdery ink is small to locations where the consumption of the powdery ink is large.

Figure 10:
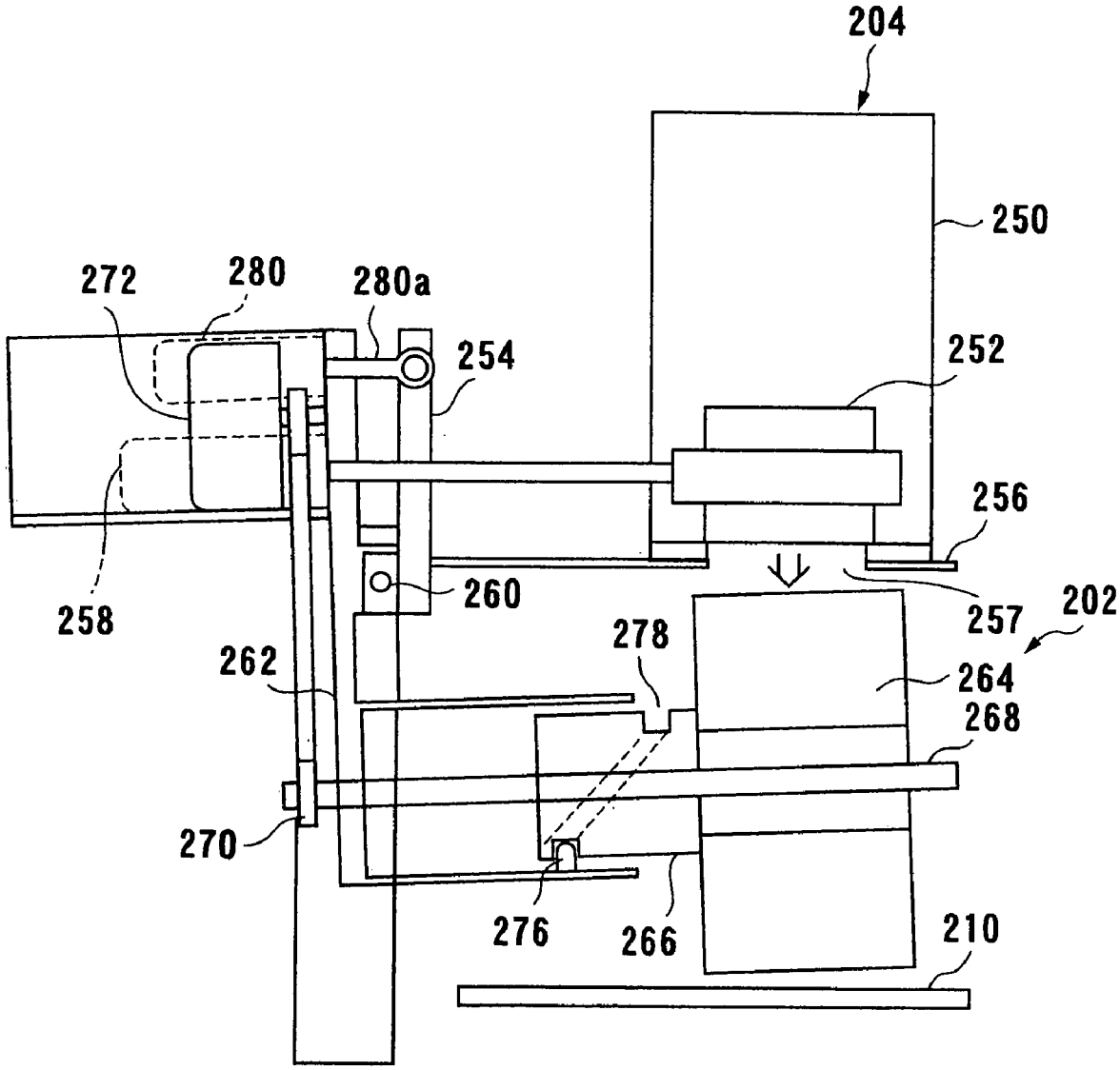
FIG. 10 is a view showing a state in which a screen brush shown in FIG. 9 moves upward.

As shown in FIG. 9, an air cylinder 280 is provided at an upper portion of the movable frame 262, and a tip end of a rod 280*a* of the air cylinder 280 is hinged to the stationary frame 254. The air cylinder 280 is operated based on the outputs from the object detecting sensor 226. Specifically, when any object 1 is not placed on a carrier pallet 206 which is moved to the printing position, the air cylinder 280 is operated to extend the rod 280*a* of the air cylinder 280 so as to rotate the movable frame 262 about the spindle 260 as shown in FIG. 10. At that time, the urethane sponge 264 of the screen brush 202 is positioned above a position shown in FIG. 9 and separated from the screen 210. Thus, in the present embodiment, the movable frame 262, the spindle 260, and the air cylinder 280 form a brush separation mechanism for separating the screen brush 202 from the screen 210.

If powdery ink is rubbed into the screen 210 while any object 1 is not present at the printing position, the powdery ink scatters below the screen 210, resulting in not only contamination of the carrier pallets 206 for transferring objects 1 and the vicinity of carrier devices, but also useless consumption of the powdery ink. Further, if an object 1 is placed on a carrier pallet 206 that has been contaminated by powdery ink, then a bottom of the object 1 is also contaminated. In the present embodiment, when any object 1 is not placed on a carrier pallet 206 which is moved to the printing position, the urethane sponge 264 of the screen brush 202 is separated from the screen 210. Thus, any powdery ink is not rubbed into the screen 210. Therefore, it is possible to eliminate contamination of the carrier pallets 206 and the vicinity of carrier devices, and useless consumption of the powdery ink. It is desirable that operation of the hopper brush rotation motor 258 is stopped so as to stop supply of the powdery ink from the hopper 204 to the screen brush 202 while the air cylinder 280 is operated.

In the present embodiment, a plurality of screen brushes 202 are not provided, but powdery ink is rubbed into the screen 210 with a single screen brush 202. A plurality of screen brushes 202 may be used to rub a large amount of powdery ink into the screen 210 in a short time. In such a case, unless each screen brush 202 has the same positional relationship between the screen brush 202, a screen 210, and an object 1, shear is caused in printing. Because the screen brush 202 in the present embodiment employs a brush having a large diameter, a required amount of powdery ink can be rubbed by one brush. Therefore, shear is not caused in printing, and thus clean printing can be achieved.

Figure 11:
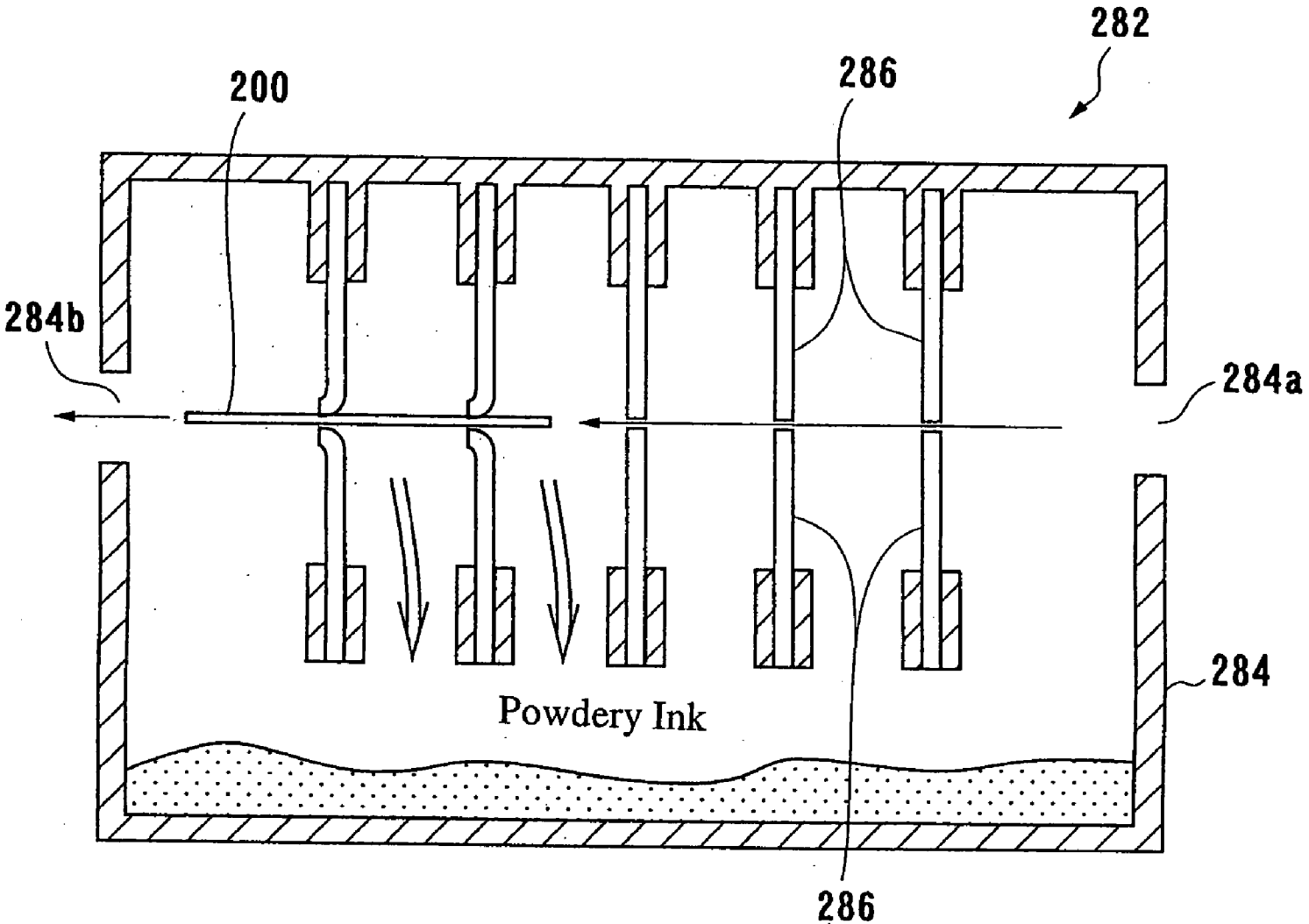
FIG. 11 is a vertical cross-sectional view of an ink recovery device shown in FIG. 5.

As shown in FIG. 5, an ink recovery device 282 for recovering powdery ink, which has not used for printing, from the screen units 200 after printing is provided at the first intermediate position in the printing section 110. FIG. 11 is a vertical cross-sectional view of the ink recovery device 282 shown in FIG. 5. As shown in FIG. 11, the ink recovery device 282 has a recovery box 284 having an introduction port 284*a* formed therein for introducing the screen unit 200 thereinto and a discharge port 284*b* formed therein for discharging the screen unit 200 therefrom. The recovery box 284 has a plurality of rubber plates (abutment pieces) 286 which are brought into abutment on upper and lower surfaces of the screen units 200 moving within the recovery box 284. The screen units 200 are introduced through the introduction port 284*a* of the recovery box 284 into the interior of the recovery box 284, where the rubber plates 286 therein are brought into abutment on the upper and lower surfaces of the screen units 200. Thus, powdery ink which has not been used for printing is scraped and collected by the rubber plates 286 and dropped onto a bottom of the recovery box 284 after the screen unit 200 has passed through the rubber plates 286. The powdery ink accumulated on the bottom of the recovery box 284 can be taken out of the recovery box 284 through an outlet port, which is not shown, and reused.

A method of evacuating powdery ink by vacuum has been known as a method of recovering powdery ink which has not used for printing. However, with such a method, because dust in air is also evacuated together with powdery ink, recovered powdery ink cannot be reused, but has to be discarded. Powdery ink which is not used for printing is about 30 percent of the entire powdery ink. Therefore, a large amount of powdery ink becomes useless with a method using vacuum. In the present embodiment, with the ink recovery device as described above, only powdery ink can readily be recovered. Since impurities such as dust are not contained in the recovered powdery ink, the recovered powdery ink can be reused. Therefore, it is possible to reduce running cost of the apparatus.

Figure 12:
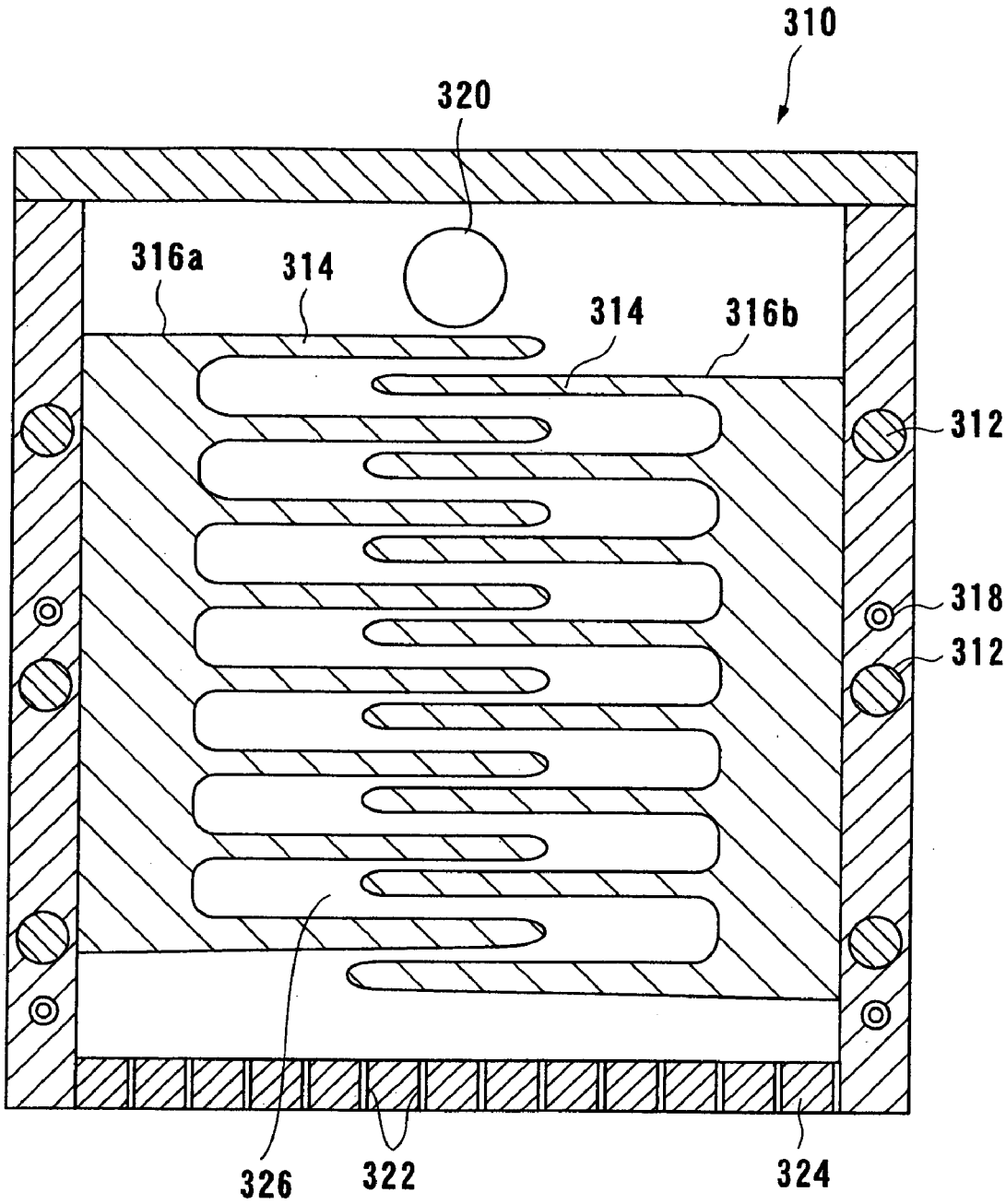
FIG. 12 is a vertical cross-sectional view of a fixing device shown in FIG. 5.

Next, the fixing device 310 in the present embodiment will be described below in detail. FIG. 12 is a vertical cross-sectional view showing the fixing device 310. As shown in FIG. 12, the fixing device 310 has heaters 312 embedded in sidewalls of the fixing device 310, a pair of heating portions 316*a* and 316*b* having a plurality of heating fins 314, and temperature sensors 318 for detecting temperatures of the heaters 312. The fixing device 310 has a steam introduction port 320 formed in an upper portion thereof for introducing steam of, for example, 100° C. The steam introduction port 320 is connected to a steam source, which is not shown. An ejection plate 324 having a plurality of slits 322 is disposed at a lower portion of the fixing device 310. A pair of heating portions 316*a* and 316*b* are arranged such that the heating fins 314 of the respective heating portions are alternately disposed. Thus, a meandering passage 326 is formed between the heating portions 316*a* and 316*b*.

Steam introduced from the steam introduction port 320 flows through the meandering passage 326 between the heating portions 316*a* and 316*b* while contacting the heating fins 314 which have been heated and becomes high-temperature steam of, for example, 400° C. in a short time. The high-temperature steam is ejected from the slits 322 in the ejection plate 324 toward a surface of an object 1. Since the heating fins 314 of the heating portion 316*a*, 316*b* are alternately disposed, contacting areas of the heating fins 314 with the steam become so large that the temperature of the steam can reliably be increased in a short time. At that time, steam having a temperature required to fix an object 1 is produced by adjusting the temperatures of the heaters 312 through the temperature sensors 318. The temperature of steam to be ejected is required to be set according to the specific heat or the surface temperature of an object 1. For example, objects having a low specific heat, such as steamed buns, require high-temperature steam of about 120° C., and object having a high specific heat, such as omelets, require high-temperature steam of about 400° C.

When powdery ink attached onto a surface of an object is to be fixed by steam, if the temperature of the surface of the object is low, steam contacting the surface of the object is lowered in temperature to produce dew. If steam excessively produces dew, the surface of the object becomes so wet that the printed powdery ink flows and cannot be fixed well. In order to prevent such a phenomenon, it is necessary to eject high-temperature steam to a surface of an object for a short period (2 to 5 seconds) to provide moisture and temperature sufficient to cleanly fix powdery ink without flowing on the surface of the object.

In order to fix the powdery ink attached to the object 1 by steam, the powdery ink is required to absorb moisture from the steam to form a gel. When heat of 80° C. or more is applied to the gelated powdery ink, the powdery ink is hardened and fixed to a surface of the object. At that time, unless the surface of the object 1 has temperatures of 80° C. or more as with the powdery ink, the powdery ink is not completely fixed. According to the present embodiment, high-temperature steam having temperatures required to fix powdery ink can be ejected from the slits 322 in the ejection plate 324 instantly and continuously. Therefore, the powdery ink does not flow because of moisture and can completely be fixed, so that clean printing is performed.

As described above, the screen unit 200 is moved so as to trace the elliptic orbit in synchronism with the objects 1 transferred by the carrier conveyer 208. When the screen unit 200 is moved to the printing position, powdery ink is rubbed into the screen 210 of the screen unit 200 by the screen brush 202 to attach and print the powdery ink onto a surface of the object 1. The screen unit 200 after printing is introduced into the ink recovery device 282 located at the first intermediate position, and powdery ink remaining on the upper and lower surfaces of the screen unit 200 is recovered therein. Then, the screen unit 200 is moved through the working position and the second intermediate position and then to the printing position, where the aforementioned printing process is performed. Such a sequence of processes is continuously repeated. A cleaning device for evacuating powdery ink firmly attached to upper and lower surfaces of the screen unit 200 by vacuum may be provided at the second intermediate position.

As described above, an electrostatic printing apparatus according to the present invention, since electrostatic printing can be performed continuously, a printing speed is remarkably improved to enhance a printing efficiency. Further, an electrostatic printing apparatus can be made compact and lightweight with a simple arrangement and provided at low cost. Furthermore, since the screens 210 can be cleaned at the working position, it is not necessary to stop operation of the apparatus for the purpose of cleaning the screens 210. Thus, a rate of operation can be improved.

In the third embodiment described above, there has been described an example in which a plurality of screen units 200 are moved on the horizontal plane so as to trace an elliptic orbit. However, the present invention is not limited to this example. For example, a plurality of screen units 200 may be moved vertically.

Figure 13:
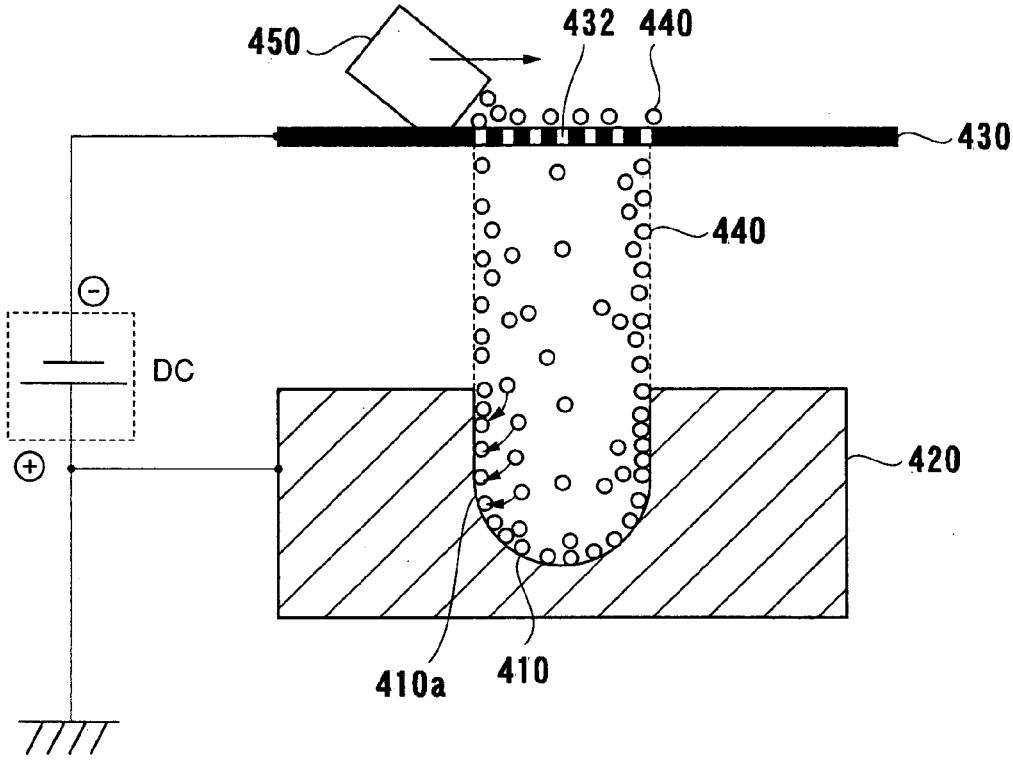
FIG. 13 is a schematic view showing an electrostatic printing apparatus according to a fourth embodiment of the present invention.
Figure 14:
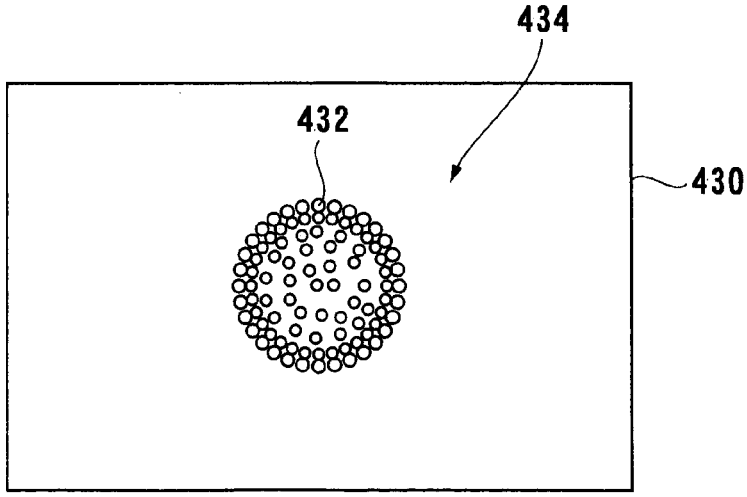
FIG. 14 is a plan view showing a stencil screen of the electrostatic printing apparatus shown in FIG. 13.

Next, there will be described embodiments of a food producing method with use of an electrostatic printing apparatus according to the present invention. Components or elements having the same effects and functions are designated by the same reference numbers throughout the following description and drawings and will not be described repetitively. FIG. 13 is a schematic view showing an electrostatic printing apparatus according to a fourth embodiment of the present invention, and FIG. 14 is a plan view showing a stencil screen of the electrostatic printing apparatus shown in FIG. 13.

As shown in FIG. 13, a stencil screen 430 made of a conductive material is disposed above a food molding receptacle 420 having a recess 410 formed therein for molding a food. As shown in FIG. 14, the screen 430 has a plurality of openings 432 formed therein which correspond to the recess 410 of the molding receptacle 420 and form a pattern 434 into which edible powder 440 is rubbed. Many openings 432 are formed at portions corresponding to a side surface 410*a* of the recess 410 in the molding receptacle 420, i.e. at a peripheral portion of the pattern 434. The molding receptacle 420 and the screen 430 are connected to a direct-current power supply DC, respectively.

First, the edible powder 440 applied onto the screen 430 is rubbed by a rubbing brush 450. At that time, a high direct-current voltage is applied between the molding receptacle 420 and the screen 430 by the direct-current power supply DC to form an electrostatic field between the molding receptacle 420 and the screen 430. The edible powder 440 that has passed through the openings 432 and has thus been charged travels straight toward the molding receptacle 420, which serves as a counter electrode, in the electrostatic field. Accordingly, the edible powder 440 is attached onto an inner surface of the recess 410 in the molding receptacle 420.

The side surface 410*a* of the recess 410 extends vertically in the molding receptacle 420. Because the side surface 410*a* has an application area larger than an area of the opposing screen pattern, powder particles 440 traveling straight toward the molding receptacle 420 are unlikely to attached onto the side surface 410*a* as compared to other portions. Therefore, since more openings 432 are formed at portions corresponding to the side surface 410*a* as described above, more powder particles 440 are applied near the side surface 410*a*. Thus, the edible powder 440 can be applied to the entire inner surface of the recess 410 in the molding receptacle 420 in a state such that the edible powder 440 has a uniform thickness over the entire inner surface of the recess 410.

The edible powder 440 thus attached to the inner surface of the recess 410 in the molding receptacle 420 is firmly attached onto the inner surface of the molding receptacle 420 by electrostatic forces. Further, since the edible powder 440 is applied by electrostatic forces as described above, powder having a relatively small particle diameter can be used, so that the weight of powder attached to the inner surface of the molding receptacle 420 can be reduced. Therefore, the powder attached to the side surface 410*a* of the recess 410 in the molding receptacle 420 does not drop onto a bottom of the recess 410 in the molding receptacle 420, but firmly attaches to the side surface 410*a* by electrostatic forces.

After the edible powder 440 is applied to the recess 410 in the molding receptacle 420, a food material is flowed into the recess 410 to mold a food. For example, baking powder serving as a remover for the food molding receptacle 420 is applied uniformly onto the inner surface of the recess 410 in the molding receptacle 420, and then a food material is flowed into the recess 410 of the molding receptacle 420 to mold a food.

As described above, in the present embodiment, the edible powder 440 can be attached firmly onto the inner surface of the molding receptacle 420. Therefore, when a food molded by flowing a food material into the molding receptacle 420 is separated from the molding receptacle 420, the edible powder 440 is not removed from a surface of the food. Accordingly, useless consumption of edible powder can be reduced, and a food having good appearance can be produced readily.

Figure 15:
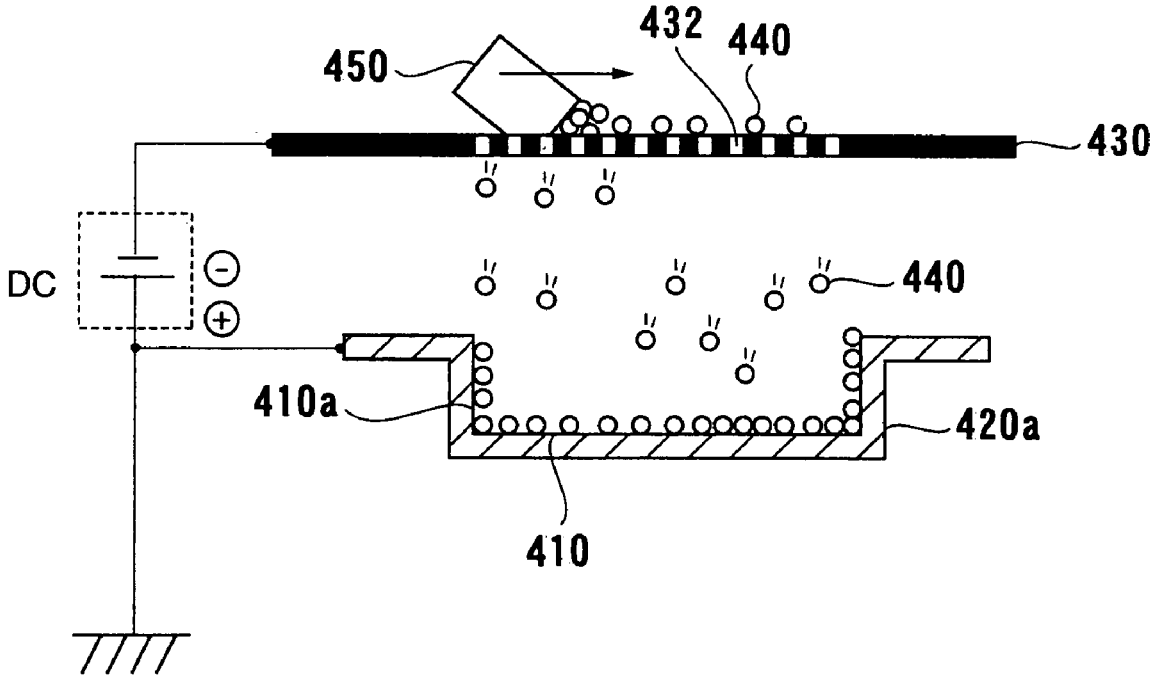
FIG. 15 is a schematic view showing an electrostatic printing apparatus according to a fifth embodiment of the present invention.

FIG. 15 is a schematic view showing an electrostatic printing apparatus according to a fifth embodiment of the present invention. In an example shown in FIG. 15, powdery fat and oil 440 as edible powder are applied onto a surface of a baking plate 420*a* as a food molding receptacle by an electrostatic printing apparatus to oil an inner surface of the baking plate 420*a*. The powdery fat and oil 440 that have been pushed out through a stencil screen 430 travel straight toward the baking plate 420*a* by electrostatic forces and are attached onto the surface of the baking plate 420*a*. According to a food producing method in the present embodiment, a required amount of oil 440 can be applied as powdery oil at required portions of the baking plate 420*a* to reduce loss. Further, since the powdery fat and oil 440 are not scattered at any portions other than the required portions, the vicinity of the printing position is not contaminated by oil.

Figure 16:
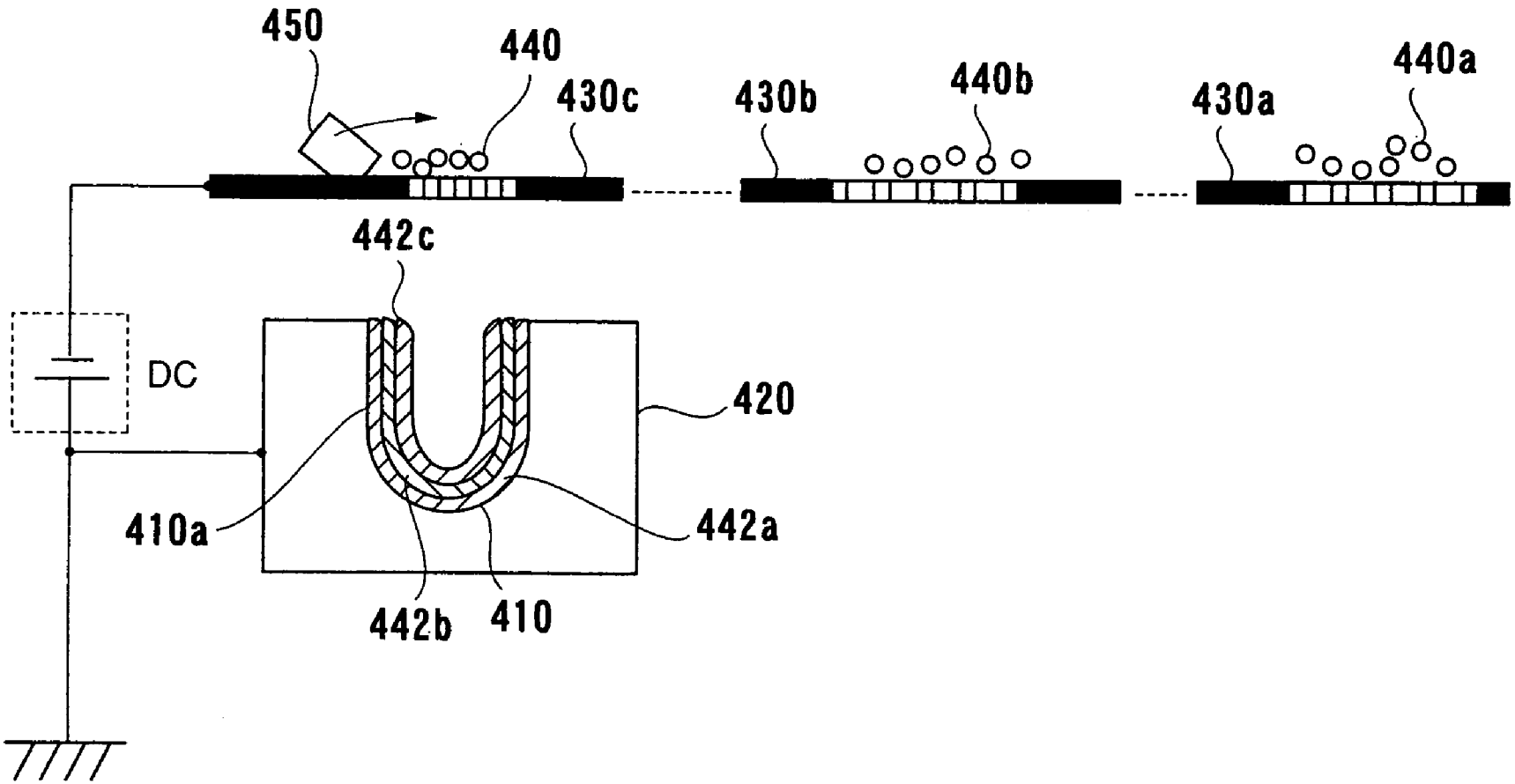
FIG. 16 is a schematic view showing an electrostatic printing apparatus according to a sixth embodiment of the present invention.

FIG. 16 is a schematic view showing an electrostatic printing apparatus according to a sixth embodiment of the present invention. As shown in FIG. 16, the electrostatic printing apparatus in the present embodiment has a plurality of stencil screens (three screens 430*a*, 430*b*, and 430*c* in the example shown in FIG. 16), and these stencil screens 430*a*, 430*b*, and 430*c* can be disposed alternately above a food molding receptacle 420.

First, first edible powder 440*a* distributed onto the first screen 430*a* is rubbed into the first screen 430*a* by a rubbing brush 450. At that time, a high direct-current voltage is applied between the molding receptacle 420 and the first screen 430*a* by a direct-current power supply DC to form an electrostatic field between the molding receptacle 420 and the first screen 430*a*. The first edible powder 440*a* that has passed through openings formed in the first screen 430*a* and has thus been charged travels straight toward the molding receptacle 420, which serves as a counter electrode, in the electrostatic field. Accordingly, the first edible powder 440*a* is attached uniformly onto an inner surface of the recess 410 in the molding receptacle 420 to form a first edible powder layer 442*a*.

Next, a second screen 430*b* is disposed above the molding receptacle 420, and second edible powder 440*b* distributed onto the second screen 430*b* is rubbed into the second screen 430*b* by the rubbing brush 450. Thus, the second edible powder 440*b* travels straight toward the molding receptacle 420, which serves as a counter electrode, in the electrostatic field and is attached uniformly onto the inner surface of the recess 410 in the molding receptacle 420 to form a second edible powder layer 442*c* on the first edible powder layer 442*a*.

Next, a third screen 430*c* is disposed above the molding receptacle 420, and third edible powder 440*c* distributed onto the third screen 430*c* is rubbed into the third screen 430*c* by the rubbing brush 450. Thus, the third edible powder 440*c* travels straight toward the molding receptacle 420, which serves as a counter electrode, in the electrostatic field and is attached uniformly onto the inner surface of the recess 410 in the molding receptacle 420 to form a third edible powder layer 442*c* on the second edible powder layer 442*b*.

After the three edible powder layers 442*a*, 442*b*, and 442*c* have been attached to the recess 410 in the molding receptacle 420, a food material is flowed into the recess 410 to mold a food. Thus, according to z food producing method in the present embodiment, a plurality of types of edible powder can repeatedly be applied with certain thicknesses. Therefore, a food having unprecedented taste can be produced.

Figure 17:
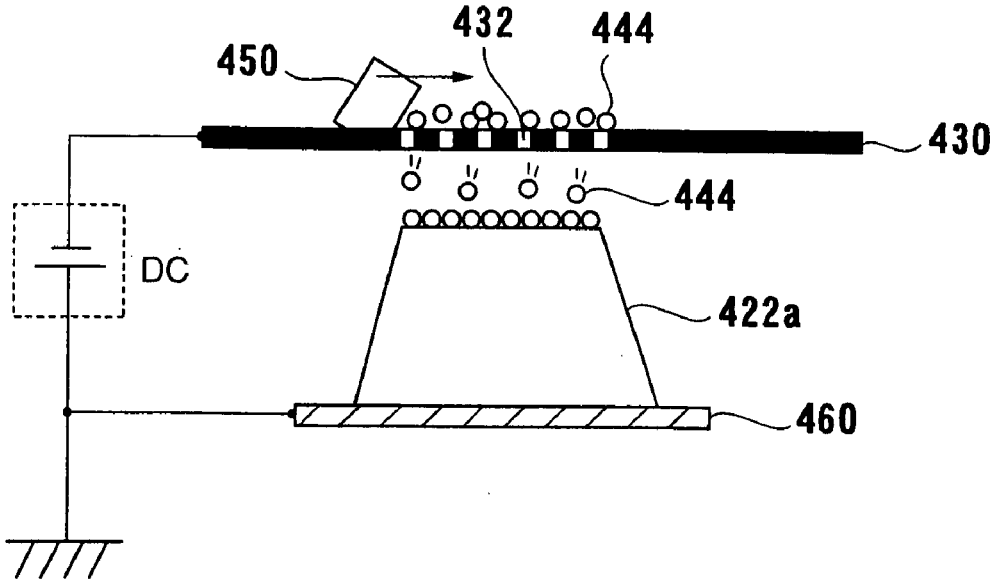
FIG. 17 is a schematic view showing an electrostatic printing apparatus according to a seventh embodiment of the present invention.

FIG. 17 is a schematic view showing an electrostatic printing apparatus according to a seventh embodiment of the present invention. In an example shown in FIG. 17, powdery seasoning 444 such as cocoa powder is applied onto a surface of a molded food 422*a* as a semi-solid such as pudding or jelly by an electrostatic printing apparatus to season the molded food 422*a*.

As shown in FIG. 17, the molded food 422*a* as a semi-solid such as pudding or jelly is placed on a process table 460 made of a conductive material, and a screen 430 is disposed above the process table 460. The screen 430 has a pattern, into which powdery seasoning 444 is rubbed, formed of openings 432. The process table 460 and the screen 430 are connected to a direct-current power supply DC, respectively.

First, powdery seasoning 444 distributed onto the screen 430 is rubbed into the screen 430 by a rubbing brush 450. At that time, a high direct-current voltage is applied between the process table 460 and the screen 430 by the direct-current power supply DC to form an electrostatic field between the molded food 422*a* and the screen 430. The powdery seasoning 444 that has passed through the openings 432 formed in the screen 430 and has thus been charged travels straight toward the process table 460, which serves as a counter electrode, in the electrostatic field. Accordingly, the powdery seasoning 444 is attached onto a surface of the molded food 422*a*. Thus, according to a food producing method in the present embodiment, powdery seasoning 444 having little moisture can be applied onto a food 422*a* having relatively much moisture, such as pudding or jelly. Therefore, the food can be seasoned without increasing the amount of moisture in the food, and thus a food having good mouthfeel and good taste can be produced.

Figure 18:
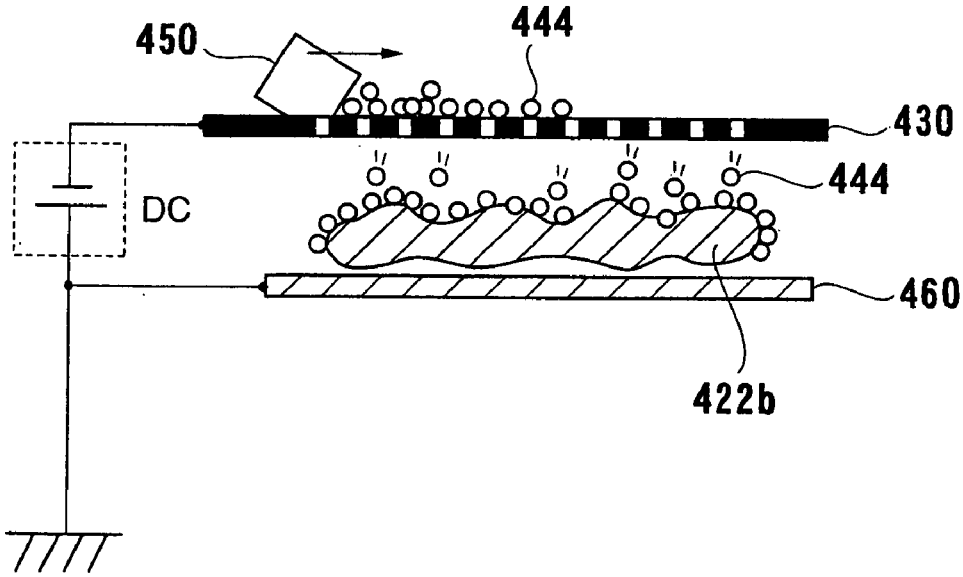
FIG. 18 is a schematic view showing an electrostatic printing apparatus according to an eighth embodiment of the present invention.

FIG. 18 is a schematic view showing an electrostatic printing apparatus according to an eighth embodiment of the present invention. In an example shown in FIG. 18, powdery seasoning 444 is applied onto a molded food 422*b* having some irregularities, such as a rice cracker, by an electrostatic printing apparatus. According to a food producing method in the present embodiment, powdery seasoning 444 can clearly and firmly be applied onto surfaces of a molded food 422*b* having some irregularities, such as a rice cracker. Further, unlike conventional cases in which water soluble sweetener or the like is applied, a drying process becomes unnecessary to simplify a food producing process.

Figure 19:
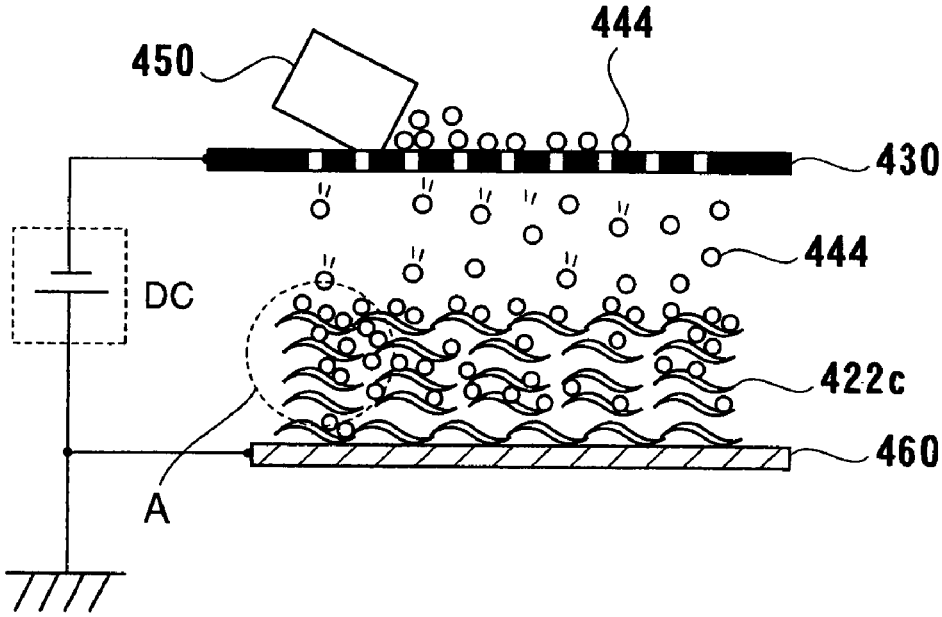
FIG. 19 is a schematic view showing an electrostatic printing apparatus according to a ninth embodiment of the present invention.
Figure 20:
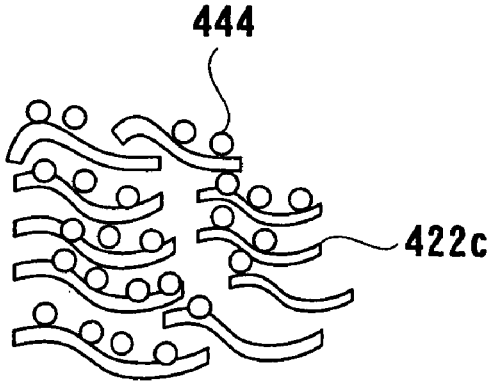
FIG. 20 is a partial enlarged view of a portion A in FIG. 19.

FIG. 19 is a schematic view showing an electrostatic printing apparatus according to a ninth embodiment of the present invention, and FIG. 20 is a partial enlarged view showing a portion A in FIG. 19. In an example shown in FIGS. 19 and 20, powdery seasoning 444 having soup taste, which is mixed with seasoning, is applied to instant dried noodles 422*c* as a molded food by an electrostatic printing apparatus. The powdery seasoning 444 that has been pushed out through a stencil screen travels straight toward the dried noodles by electrostatic forces. Because the dried noodles 422*c* have spaces therein like a sponge, the powdery seasoning 444 that has traveled toward the dried noodles 422*c* passes through gaps within the dried noodles 422*c* and also attaches firmly onto surfaces of noodles inside the dried noodles 422*c* as shown in FIG. 20.

The powdery soup (powdery seasoning 444) is firmly attached onto the instant dried noodles 422*c* thus produced. Therefore, when the instant dried noodles 422*c* is put into hot water, the powdery soup is melt into the hot water so as to produce soup having flavor. Thus, the instant noodles are cooked readily. With a conventional method of producing seasoned dried noodles, it is necessary to dry noodles after immersing noodles in liquid seasoning. However, according to a food producing method in the present embodiment, it is not necessary to dry noodles, and thus seasoned dried noodles can be produced extremely readily. Some powdery fat and oil may be added to the powdery seasoning 444, then heated after the application to melt the powdery fat and oil, and solidified to reinforce attachment forces of the powdery seasoning 444 attached to the dried noodles 422*c*.

Figure 21:
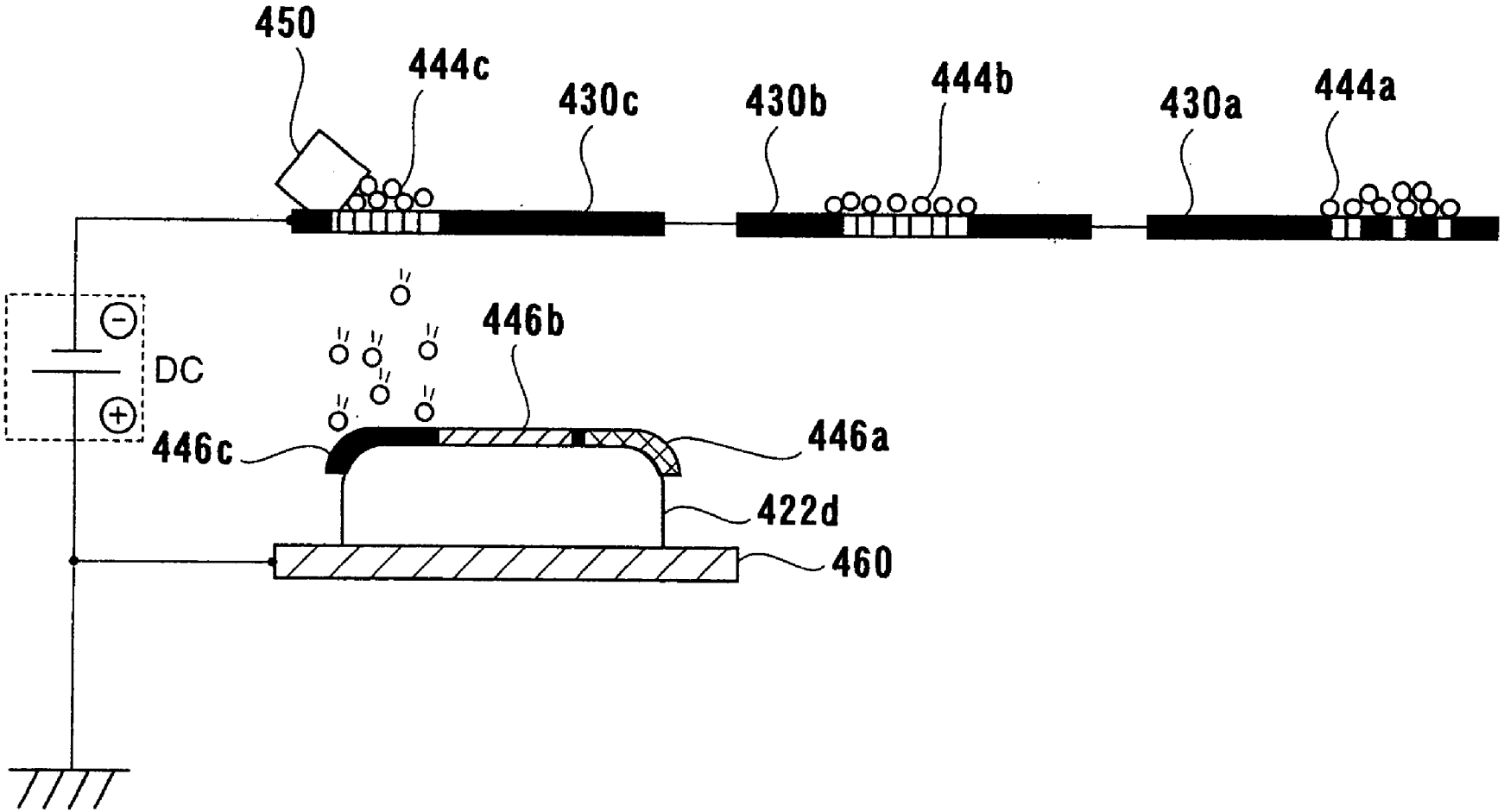
FIG. 21 is a schematic view showing an electrostatic printing apparatus according to a tenth embodiment of the present invention.
Figure 22:
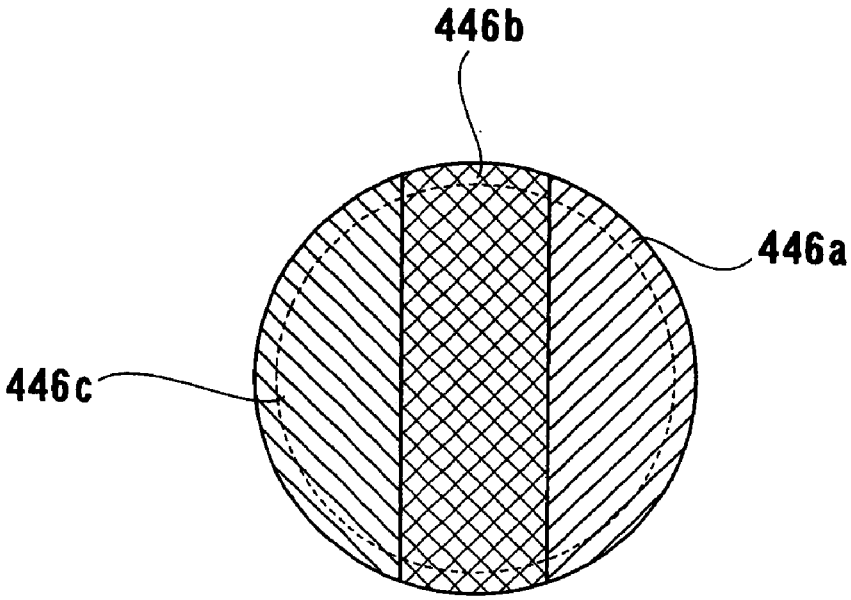
FIG. 22 is a plan view of a molded food shown in FIG. 21.

FIG. 21 is a schematic view showing an electrostatic printing apparatus according to a tenth embodiment of the present invention, and FIG. 22 is a plan view of a molded food shown in FIG. 21. As shown in FIG. 21, the electrostatic printing apparatus in the present embodiment has a plurality of stencil screens (three screens 430*a*, 430*b*, and 430*c* in the example shown in FIG. 21), and these stencil screens 430*a*, 430*b*, and 430*c* can be disposed alternately above a molded food 422*d* such as a sponge cake.

First, first powdery seasoning 444*a* distributed onto the first screen 430*a* is rubbed into the first screen 430*a* by a rubbing brush 450. At that time, a high direct-current voltage is applied between a process table 460 and the first screen 430*a* by a direct-current power supply DC to form an electrostatic field between the molded food 422*d* and the first screen 430*a*. The first powdery seasoning 444*a* that has passed through openings formed in the first screen 430*a* and has thus been charged travels straight toward the process table 460, which serves as a counter electrode, in the electrostatic field. Accordingly, the first powdery seasoning 444*a* is attached uniformly onto a surface of the molded food 422*d* to form a first powdery seasoning layer 446*a*.

Next, a second screen 430*b* is disposed above the molded food 422*d*, and second powdery seasoning 444*b* distributed onto the second screen 430*b* is rubbed into the second screen 430*b* by the rubbing brush 450. Thus, the second powdery seasoning 444*b* travels straight toward the process table 460, which serves as a counter electrode, in the electrostatic field and is attached uniformly onto the surface of the molded food 422*d* to form a second powdery seasoning layer 446*b* adjacent to the first powdery seasoning layer 446*a*.

Next, a third screen 430*c* is disposed above the molding receptacle 422*d*, and third powdery seasoning 444*c* distributed onto the third screen 430*c* is rubbed into the third screen 430*c* by the rubbing brush 450. Thus, the third powdery seasoning 444*c* travels straight toward the process table 460, which serves as a counter electrode, in the electrostatic field and is attached uniformly onto the surface of the molded food 422*d* to form a third powdery seasoning layer 446*c* adjacent to the second powdery seasoning layer 446*b*.

Figure 23:
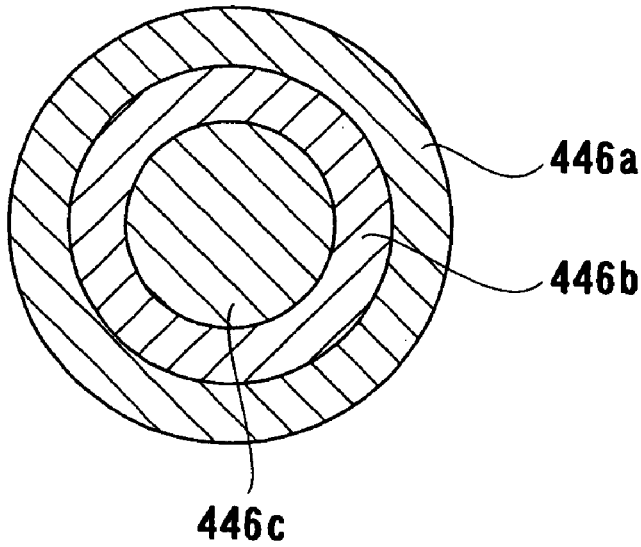
FIG. 23 is an example in which a pattern to be applied to the molded food shown in FIG. 21 is changed.

As described above, according to a food producing method in the present embodiment, the powdery seasoning layers 446*a*, 446*b*, and 446*c* can be applied separately and clearly onto the surface of the molded food 422*d*. Therefore, a food having unprecedented taste can be produced. When patterns of the screens 430*a*, 430*b*, and 430*c* are changed, for example, concentric powdery seasoning layers 446*a*, 446*b*, and 446*c* can be formed as shown in FIG. 23.

Figure 24:
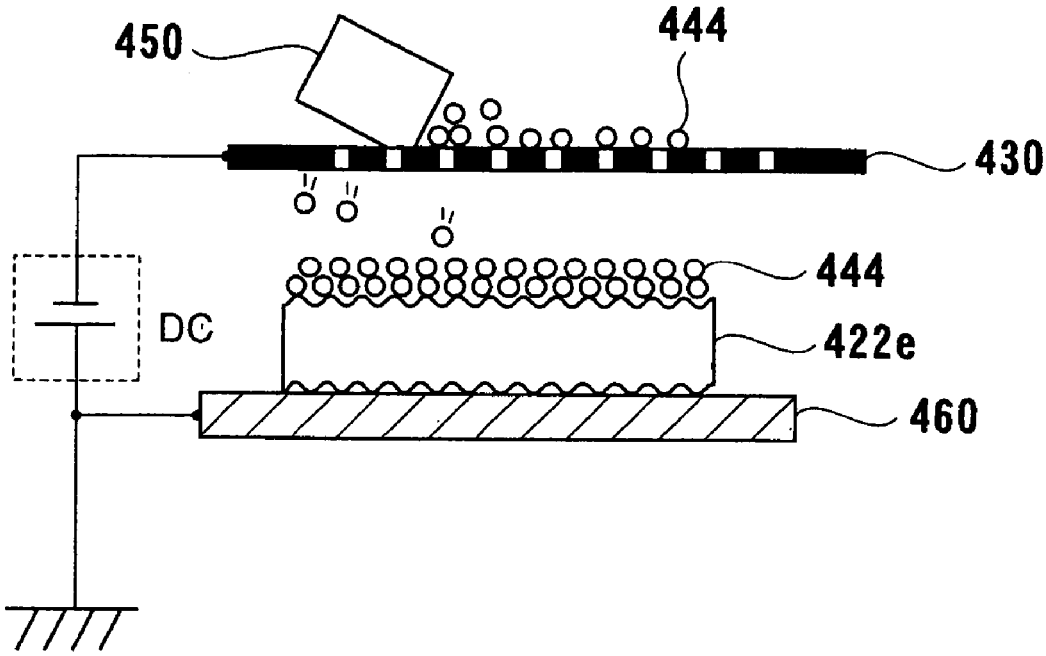
FIG. 24 is a schematic view showing an electrostatic printing apparatus according to an eleventh embodiment of the present invention.
Figure 25:
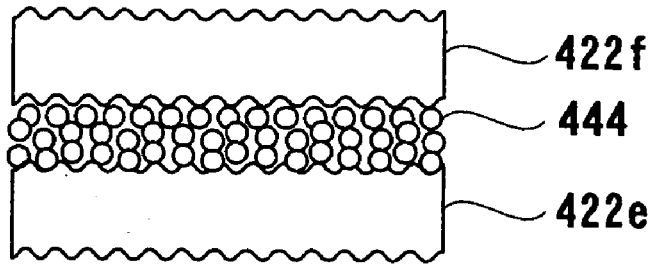
FIG. 25 is a view showing wafers produced with the electrostatic printing apparatus shown in FIG. 24.

FIG. 24 is a schematic view showing an electrostatic printing apparatus according to an eleventh embodiment of the present invention, and FIG. 25 is a view showing wafers produced by the electrostatic printing apparatus shown in FIG. 24. In an example shown in FIGS. 24 and 25, powdery seasoning 444 such as vanilla is applied onto a molded food 422*e* which is likely to be influenced by moisture, such as wafers, by an electrostatic printing apparatus. As shown in FIG. 25, after powdery seasoning 444 is applied onto a surface of a wafer 422*e*, another wafer is superimposed on the wafer 422*e*. According to a food producing method in the present embodiment, since liquid seasoning is not used, a food 422*e* which is likely to be influenced by moisture, such as a wafer, can be finished as a delicious food without spoiling mouthfeel of the food. For example, such molded foods which are likely to be influenced by moisture include seasoned dried layer, sponge cakes, rice crackers, cookies, rice balls, shrimp rice crackers, gel material such as mayonnaise applied for seasoning, fresh cream for cakes, and koya tofu.

Figure 26:
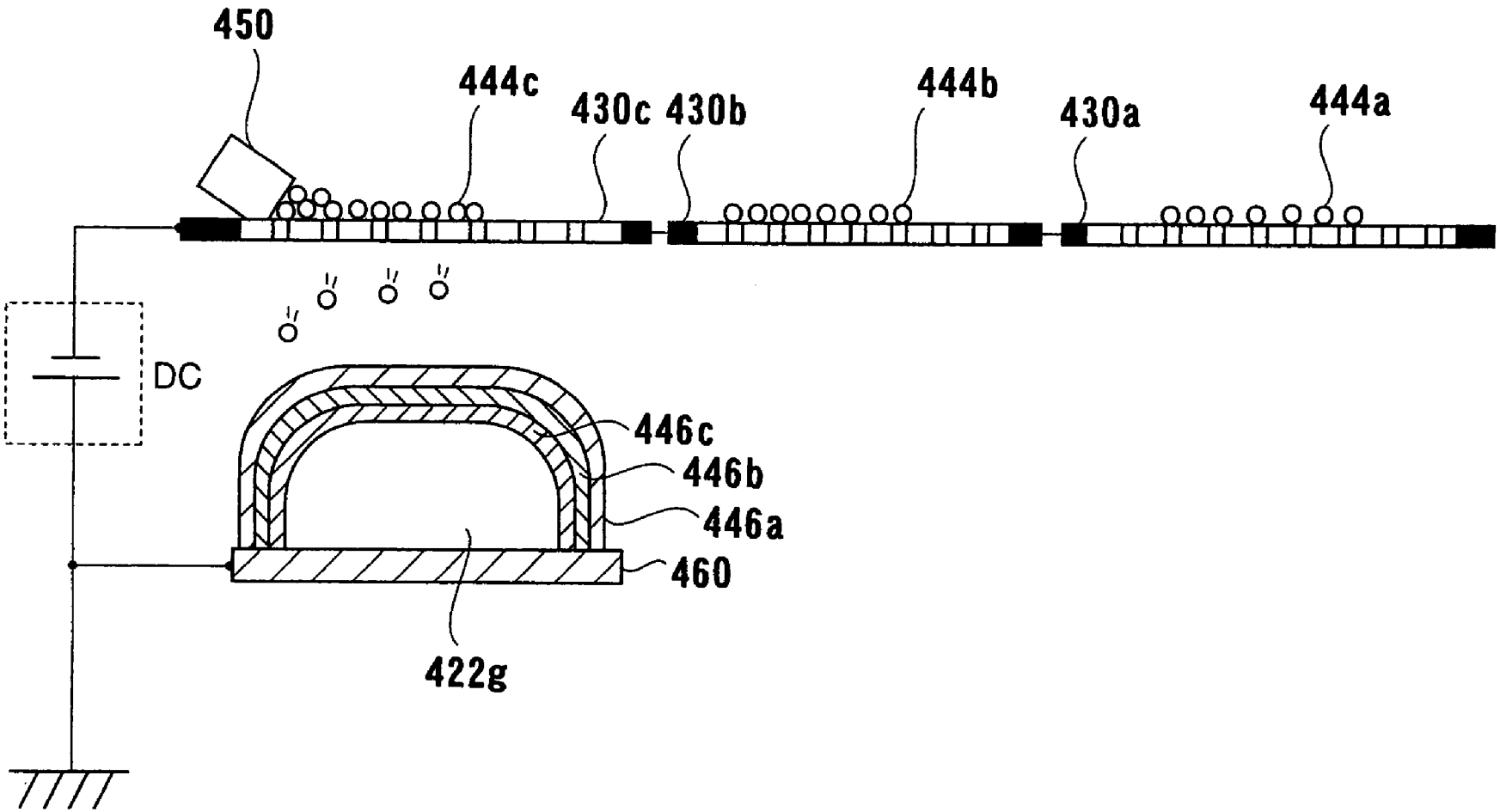
FIG. 26 is a schematic view showing an electrostatic printing apparatus according to a twelfth embodiment of the present invention.

FIG. 26 is a schematic view showing an electrostatic printing apparatus according to a twelfth embodiment of the present invention. In an example shown in FIG. 26, powdery seasoning 444*a* having, for example, strawberry flavor is applied onto a surface of a molded food 422*g* such as melon bread, then powdery seasoning 444*b* having peanut flavor is applied on an upper surface thereof, and powdery seasoning 444*c* having melon flavor is applied on an upper surface thereof. Thus, it is possible to produce melon bread having a strawberry flavor layer 446*a*, a peanut flavor layer 446*b*, and a melon flavor layer 446*c*, which are piled in order.

Figure 27:
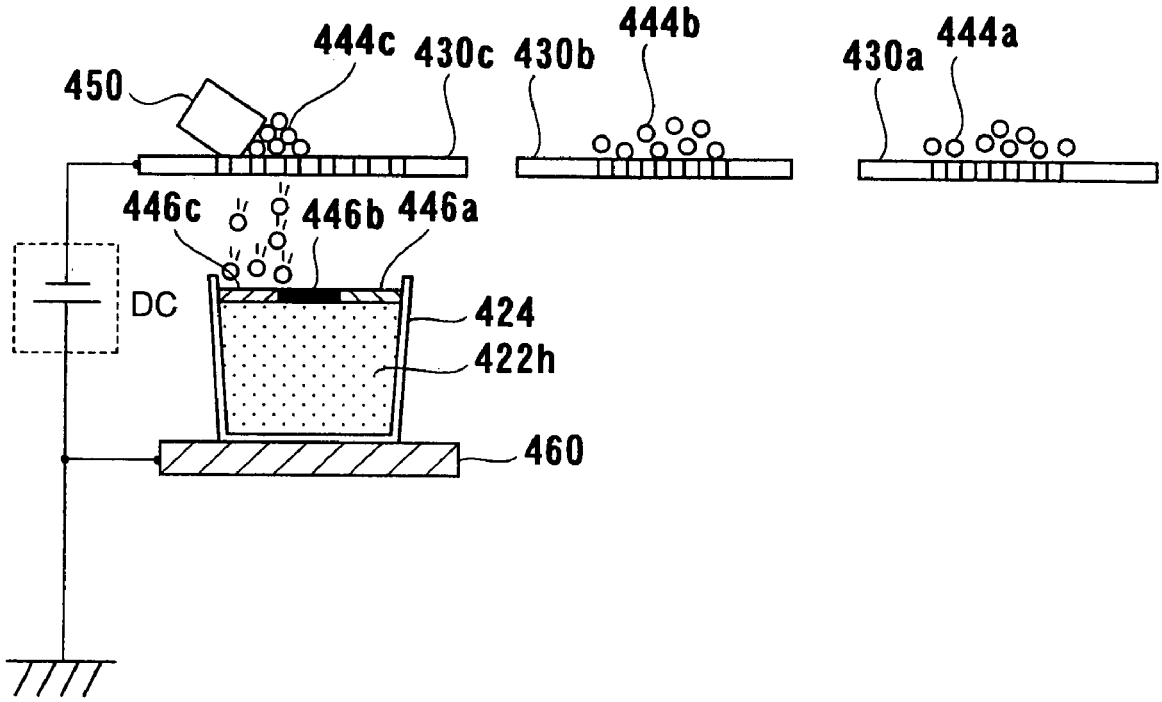
FIG. 27 is a schematic view showing an electrostatic printing apparatus according to a thirteenth embodiment of the present invention.
Figure 28:
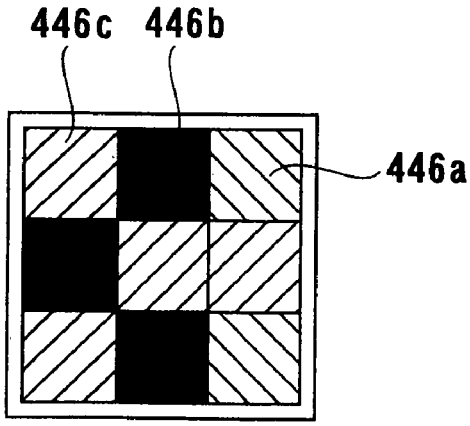
FIG. 28 is a plan view of a molded food shown in FIG. 27.

FIG. 27 is a schematic view showing an electrostatic printing apparatus according to a thirteenth embodiment of the present invention, and FIG. 28 is a plan view showing a molded food shown in FIG. 27. In an example shown in FIGS. 27 and 28, three types of powdery seasoning 444*a*, 444*b*, and 444*c* are applied onto a surface of a tiramisu 422*h* in a receptacle 424. As shown in FIG. 28, as with the tenth embodiment, different types of powdery seasoning layers 446*a*, 446*b*, and 446*c* can be formed on the surface of the tiramisu 422*h* to thereby produce a tiramisu 422*h* having different taste according to locations.

Figure 29:
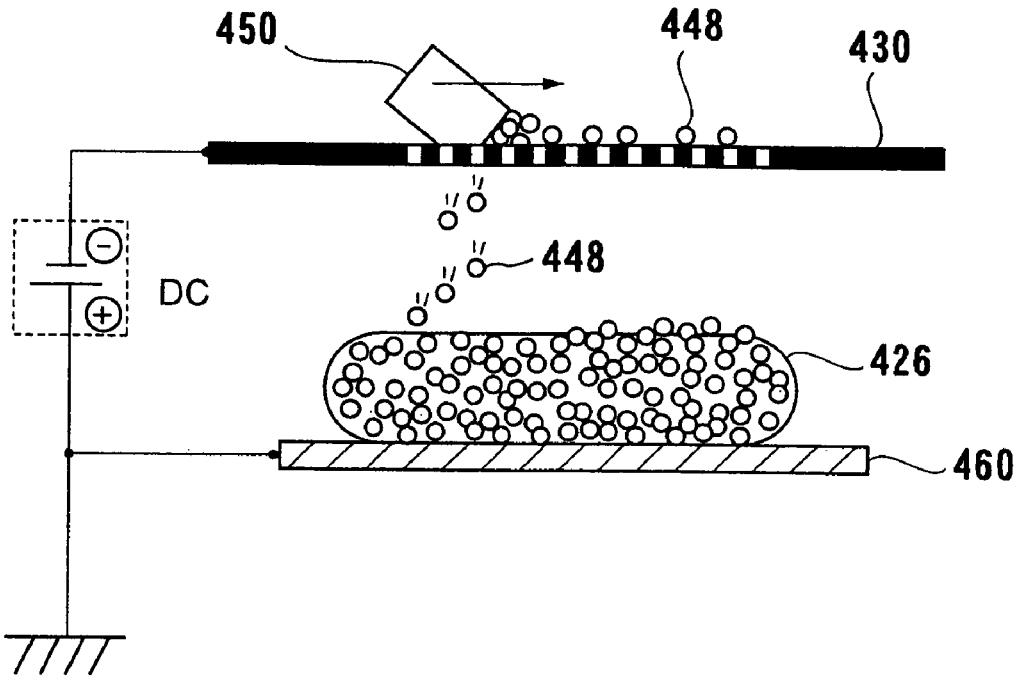
FIG. 29 is a schematic view showing an electrostatic printing apparatus according to a fourteenth embodiment of the present invention.

FIG. 29 is a schematic view showing an electrostatic printing apparatus according to a fourteenth embodiment of the present invention. In an example shown in FIG. 29, powdery fat and oil 448 are applied onto a surface of a deep-fried food having a coating, i.e. a semi-finished food 426 such as a pork cutlet, a croquette, tempura, or curry bread. When powdery fat and oil 448 are applied onto the surface of the semi-finished food 426, it is possible to produce a food which can be cooked by high-frequency heating (microwave oven). Therefore, a deep-fried food can readily be produced in the home without deep-frying in high-temperature oil unlike a conventional method. Further, it is possible to readily adjust the amount and the film thickness of powdery fat and oil 448 to be applied.

Figure 30:
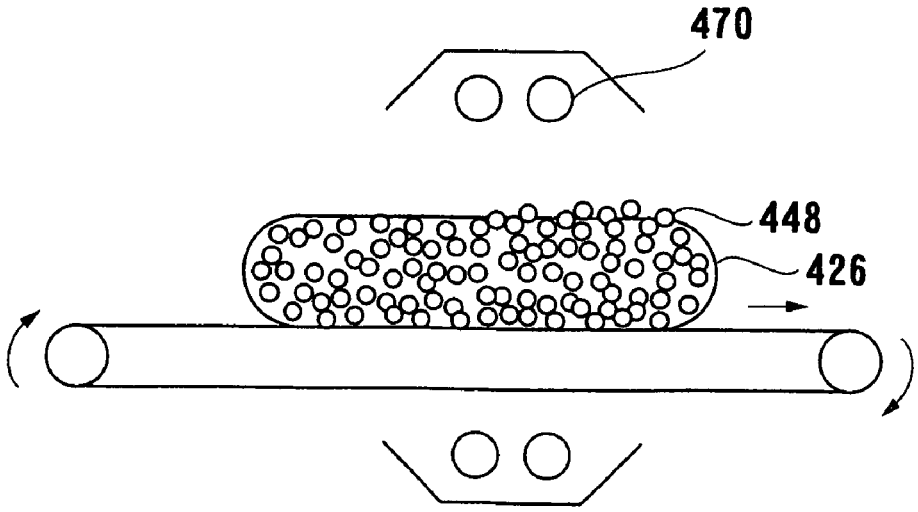
FIG. 30 is a schematic view showing a process of increasing adhesive strength of powdery fat and oil to be applied onto a food shown in FIG. 29.

When the applied powdery fat and oil 448 are required to have an adhesive strength to a certain degree, as shown in FIG. 30, the powdery fat and oil 448 may be melted and adhered on a surface of the semi-finished food 426 at temperatures near a softening point of the powdery fat and oil 448 by a heater 470 or a hot wind. Further, not only powdery fat and oil, but also edible powder having some functions may be applied to the semi-finished food 426. For example, the use of edible powder in which powdery fat and oil are mixed with gelling agent powder can obtain crisp mouthfeel by heating and cooking with a microwave oven.

According to a food producing method in the present invention, the powdery fat and oil 448 can be attached to the semi-finished food 426. Therefore, it is possible to produce a deep-fried food readily by a microwave oven in the home. Accordingly, it is not necessary to deep-fry a food in high-temperature oil. Further, since a large amount of powdery fat and oil 448 can be applied, a deep-fried food having unprecedented mouthfeel and taste can be produced by a microwave oven in the home. When a coating is provided around a food sensitive to heat, such as vegetable, and then powdery fat and oil 448 are applied thereto, it is possible to produce a deep-fried food without spoiling the food by heat or changing taste.

Figure 31:
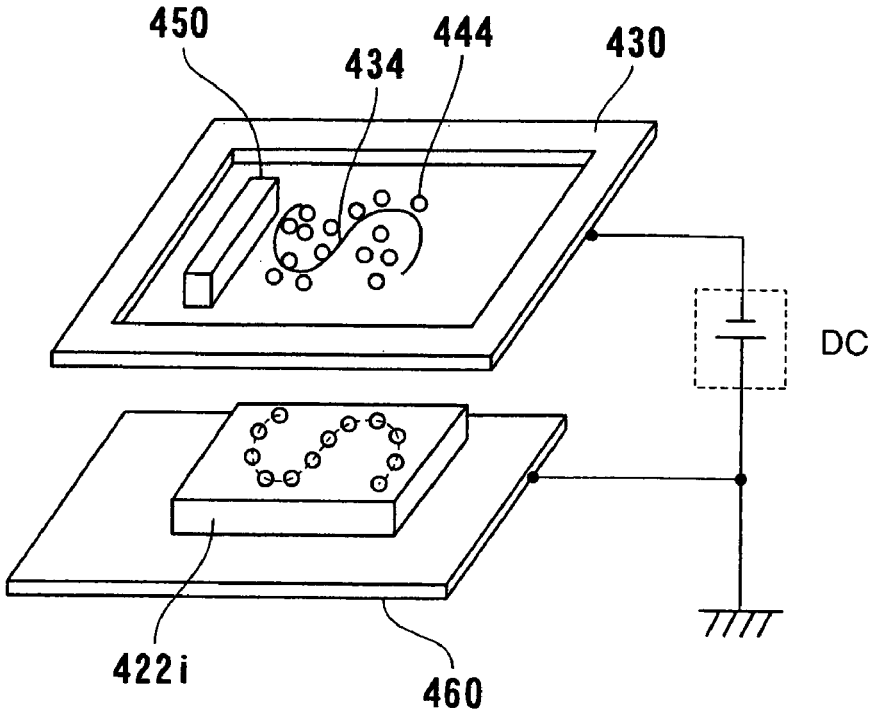
FIG. 31 is a schematic view showing an electrostatic printing apparatus according to a fifteenth embodiment of the present invention.
Figure 32:
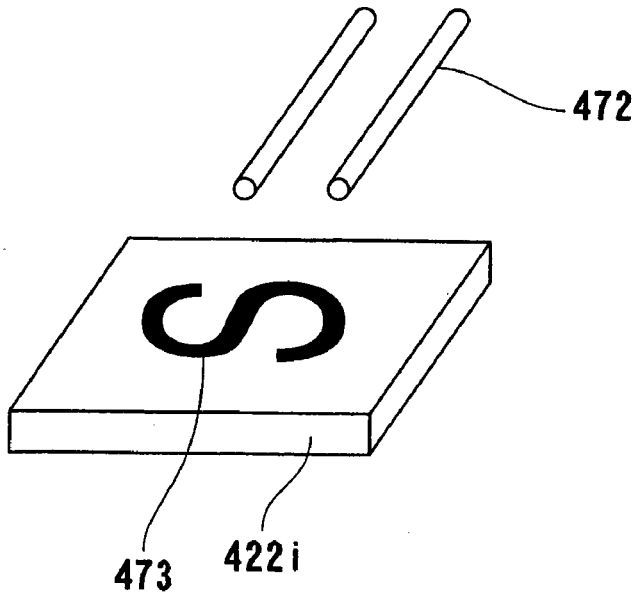
FIG. 32 is a schematic view showing a process of heating a molded food shown in FIG.31.

FIG. 31 is a schematic view showing an electrostatic printing apparatus according to a fifteenth embodiment of the present invention, and FIG. 32 is a schematic view showing a process of heating a molded food shown in FIG. 31. In an example shown in FIGS. 31 and 32, powdery seasoning 444 is applied onto a surface of bread 422*i*, for example, to season the bread. As shown in FIG. 31, a stencil screen 430 in the present embodiment has a pattern 434 including characters and figures formed therein. For example, when sugar powder or the like is used as powdery seasoning 444, and the bread 422i is heated by a toaster 472, a portion 473 on which the sugar powder is applied is burnt to emboss the figures in dark brown as shown in FIG. 32. According to a food producing method in the present embodiment, since the amount of moisture in the powdery seasoning 444 to be applied onto a surface of bread is small, mouthfeel of the bread is not spoiled. Therefore, a food having unprecedented taste and mouthfeel can be produced. Further, powdery seasoning 444 can be applied to bread onto which fresh cream or jam is applied. Furthermore, as with the examples described above, when a plurality of types of powdery seasoning 444 are applied with a multilayer, it is possible to produce bread having varied taste, which has heretofore been experienced.

Figure 33:
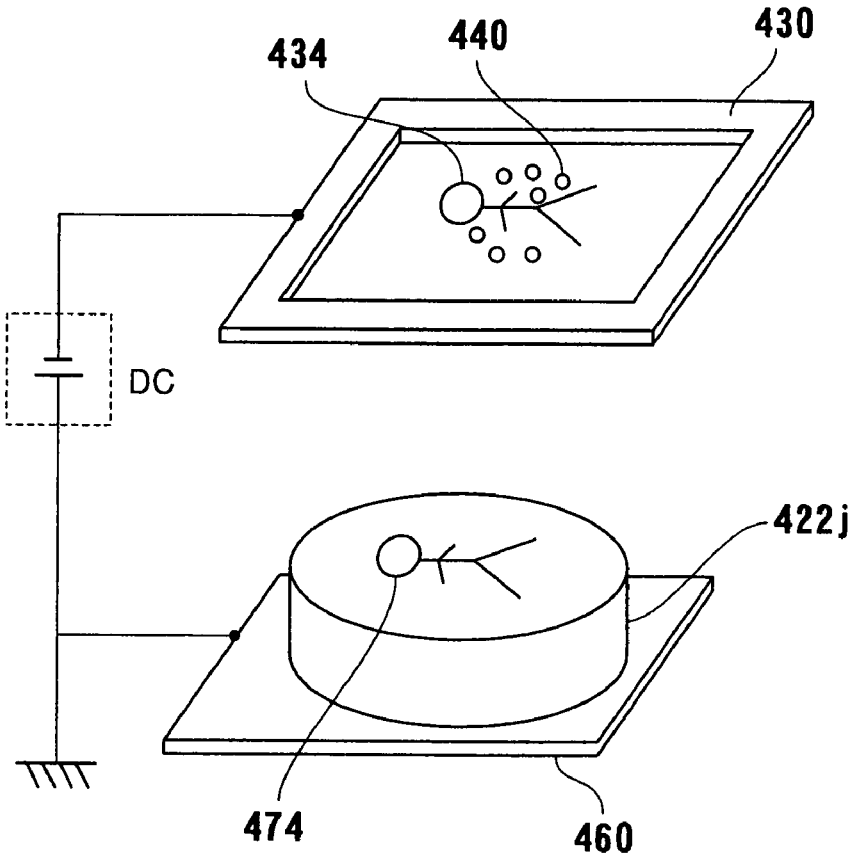
FIG. 33 is a schematic view showing an electrostatic printing apparatus according to a sixteenth embodiment of the present invention.

FIG. 33 is a schematic view showing an electrostatic printing apparatus according to a sixteenth embodiment of the present invention. In an example shown in FIG. 33, edible powder 440 is applied onto a food 422*j* such as a sponge cake to draw an outline 474 of figures. Thus, when the outline 474 of figures is drawn on a surface of the sponge cake having irregularities by the edible powder 440, it is possible to apply fresh cream along the outline 474, so that anyone can readily produce a clean fancy cake.

Figure 34:
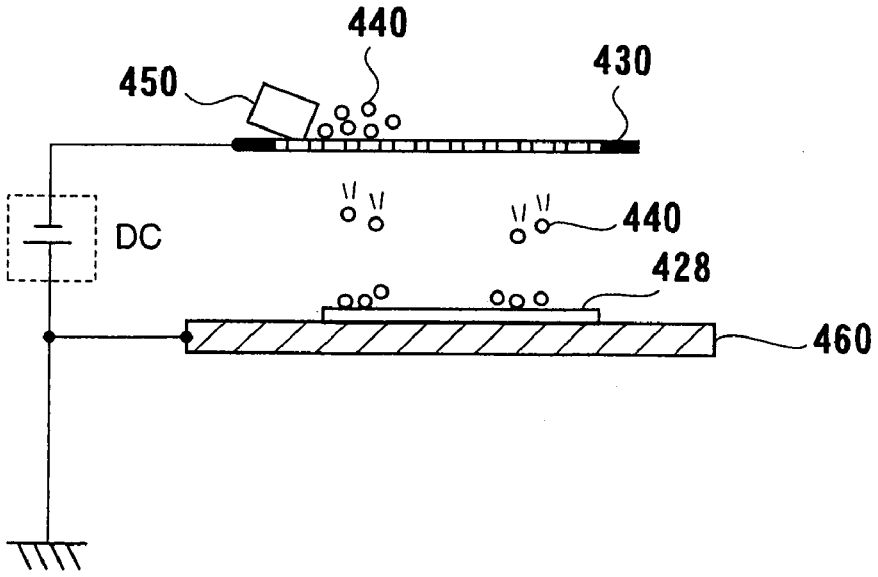
FIG. 34 is a schematic view showing an electrostatic printing apparatus according to a seventeenth embodiment of the present invention.
Figure 35:
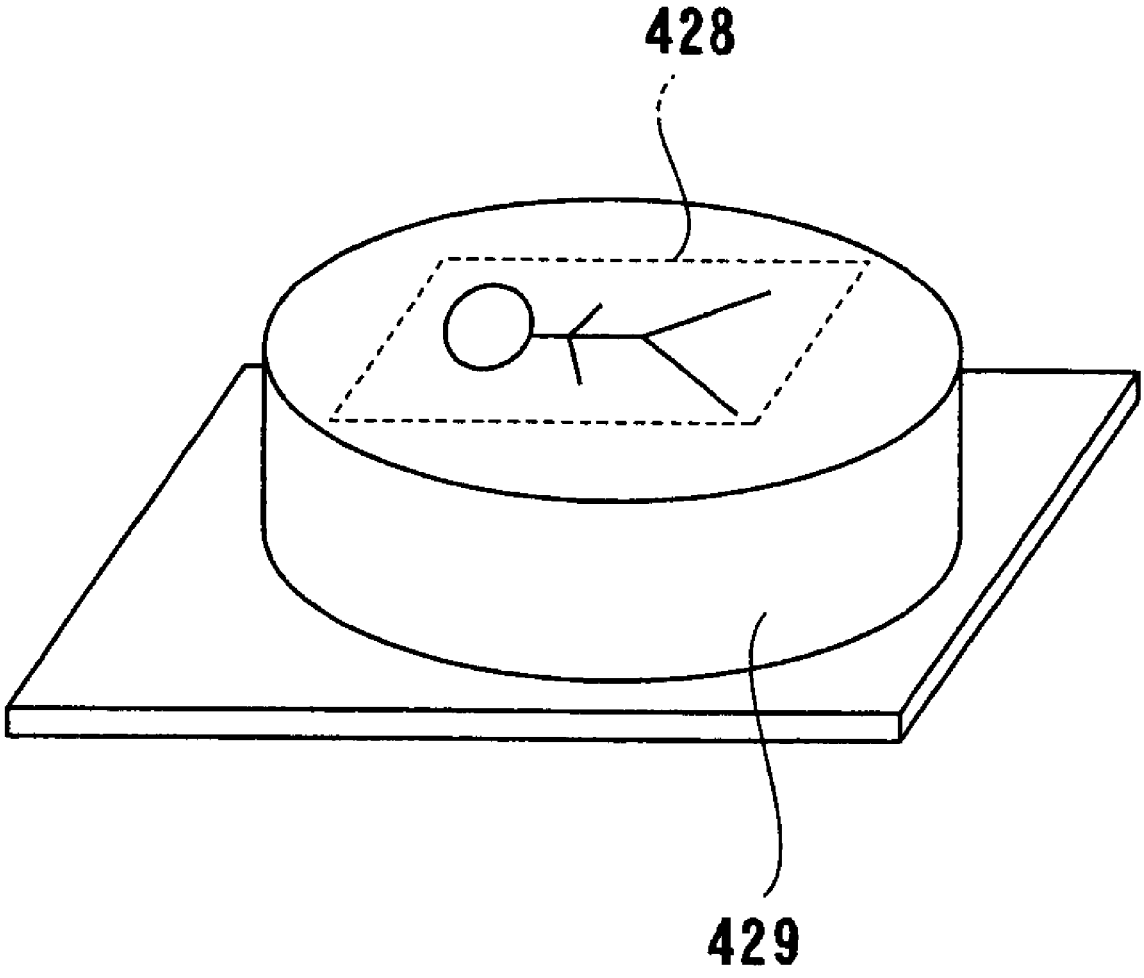
FIG. 35 is a schematic view showing an example of using an edible sheet shown in FIG. 34.

FIG. 34 is a schematic view showing an electrostatic printing apparatus according to a seventeenth embodiment of the present invention, and FIG. 35 is a schematic view showing an example of using an edible sheet shown in FIG. 34. In an example shown in FIGS. 34 and 35, edible powder 440 is applied onto a surface of an edible sheet 428 made of starch, such as a wafer. Such an edible sheet 428 has a thickness of 0.1–0.5 mm or less. The edible powder 440 is applied onto the edible sheet 428 to print figures thereon, and then the edible sheet 428 is placed on a surface of a food material 429. The edible sheet 428 absorbs moisture on the surface of the food 429. The edible sheet 428 is melted into the food and finally disappears, so that only the edible powder 440 remains on the surface of the food 429. Thus, it is possible to produce a food on which the figures are drawn. A sheet seasoned with seasoning may be used as the edible sheet 428.

According to the food producing method of the present embodiment, liquid ink is not used, and edible powder 440 is applied onto the edible sheet 428 in a non-contact manner. Therefore, it becomes unnecessary to consider the thickness of dough, and the water resistance and the strength of the edible sheet 428. Therefore, the edible sheet 428 can be made thinner. When the edible sheet 428 is placed on the food material 429, the edible sheet 428 is completely melted and disappears, so that the flavor and mouthfeel of the food are not spoiled. Further, a large amount of edible powder (seasoning such as spice or pigment) can be applied onto a surface of the edible sheet 428. Therefore, when the edible sheets 428 are placed on a surface of a food material or mixed with each other, it is possible to produce a food having unprecedented flavor, mouthfeel, and appearance.

Figure 36:
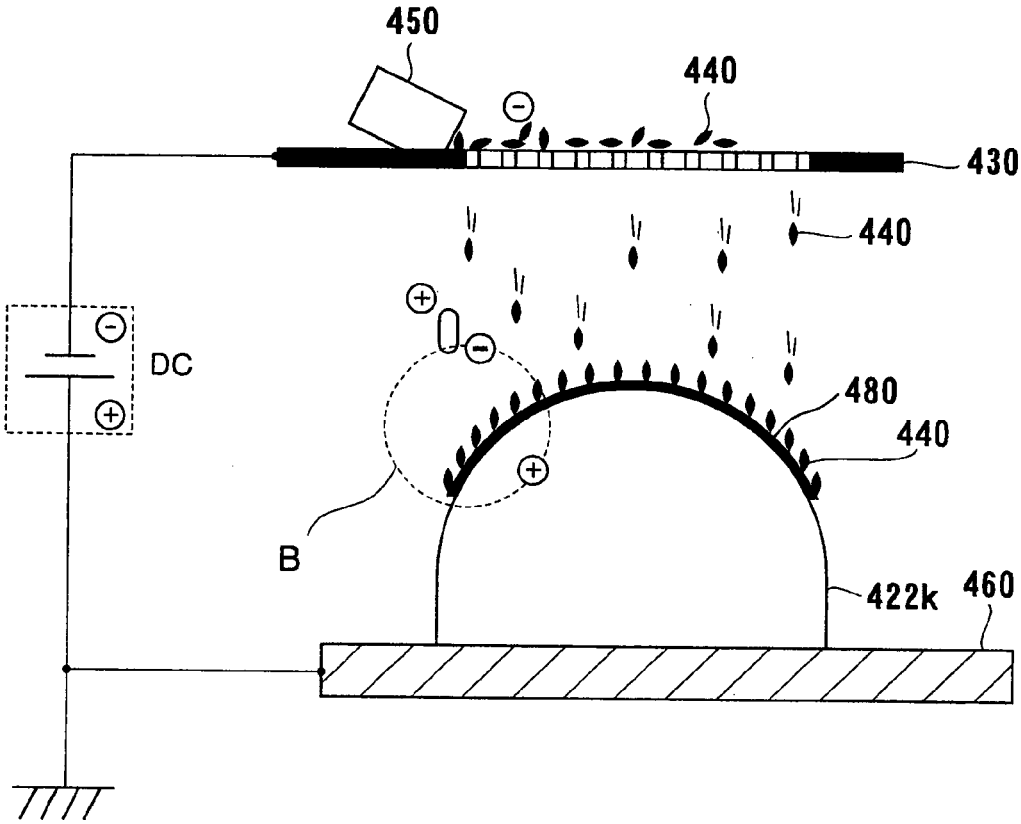
FIG. 36 is a schematic view showing an electrostatic printing apparatus according to an eighteenth embodiment of the present invention.
Figure 37:
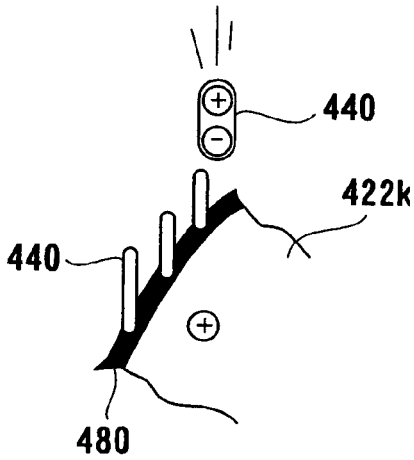
FIG. 37 is a partial enlarged view of a portion B in FIG. 36.

FIG. 36 is a schematic view showing an electrostatic printing apparatus according to an eighteenth embodiment of the present invention, and FIG. 37 is a partial enlarged view of a portion B in FIG. 36. In an example shown in FIGS. 36 and 37, fibrous edible powder 440 is applied to a molded food 422*k* onto which an edible adhesive 480 is applied by an electrostatic printing apparatus. Thus, when the edible adhesive 480 has been applied onto the molded food 422*k* in advance, the edible powder 440 is firmly attached to the molded food 422*k*. Any adhesive may be used as the edible adhesive 480 as long as it can bond a surface of the molded food 422*k* and the edible powder 440 to each other. For example, edible paste having a viscosity to a certain degree may be used. In a case where edible powder 440 is applied onto a surface of a food by an electrostatic printing apparatus, the edible powder cannot attached to a surface of a food unless the edible powder having a small particle diameter of 5 μm–80 μm. However, with an edible adhesive 480 as described above, even edible powder having a large particle diameter can be attached to a surface of the food 422*k*. Further, edible powder becomes polarized as shown in FIG. 37 on the way to the molded food 422*k*. Therefore, fibrous edible powder applied on a surface of a molded food so as to project upward.

Figure 38:
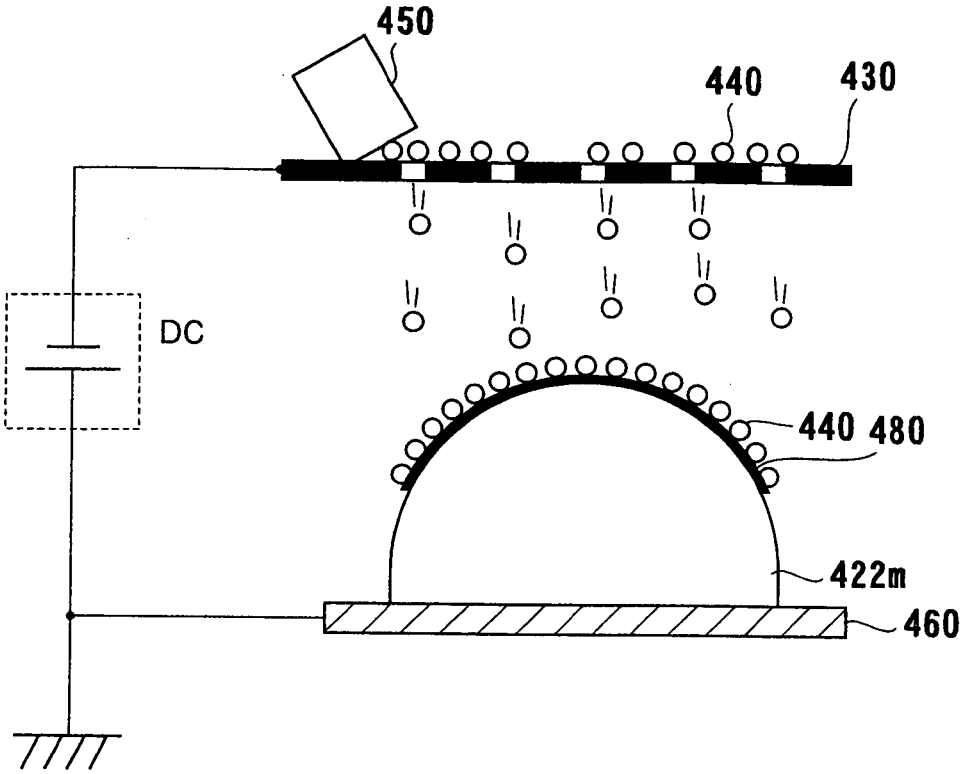
FIG. 38 is a schematic view showing an electrostatic printing apparatus according to a nineteenth embodiment of the present invention.

FIG. 38 is a schematic view showing an electrostatic printing apparatus according to a nineteenth embodiment of the present invention. In an example shown in FIG. 38, an edible adhesive 480 is applied onto a bean-jam bun 422*m* having a smooth surface, and then edible powder 440 is applied by electrostatic printing. According to a food producing method in the present embodiment, edible powder 440 can be attached onto a surface of the food 422*m* having a smooth surface.

Figure 39:
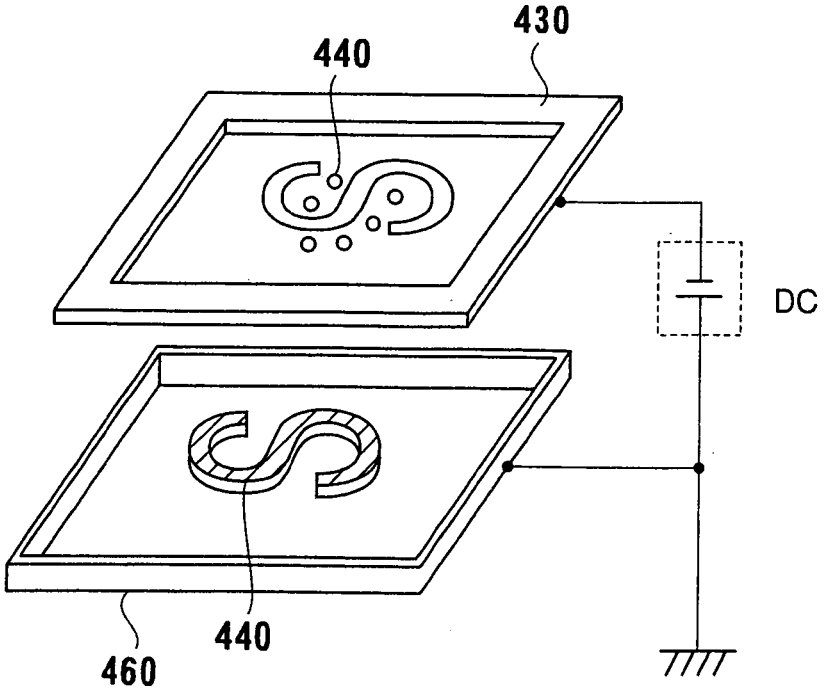
FIG. 39 is a schematic view showing an electrostatic printing apparatus according to a twentieth embodiment of the present invention.

FIG. 39 is a schematic view showing an electrostatic printing apparatus according to a twentieth embodiment of the present invention. In an example shown in FIG. 39, edible powder 440 is stacked with a pattern formed in a stencil screen 430 on a process table (process plate) 460, and then heated and burnt for formation. According to a food producing method in the present embodiment, it is possible to produce a food having the same pattern as in a conventional method without skill and experience. For example, sugar powder is applied onto the process table 460 with a pattern of a screen to accumulate the sugar powder, and then the process table 460 is heated to melt the sugar powder and cooled. Thus, it is possible to readily produce bekkou candy.

Figure 40A:
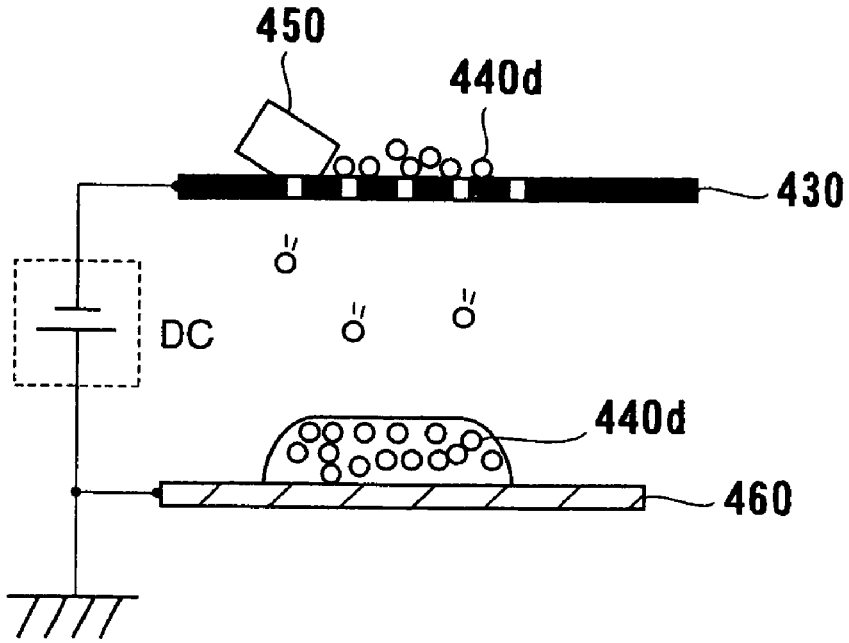
FIGS. 40A and 40B are schematic views showing an electrostatic printing apparatus according to a twenty first embodiment of the present invention.
Figure 40B:
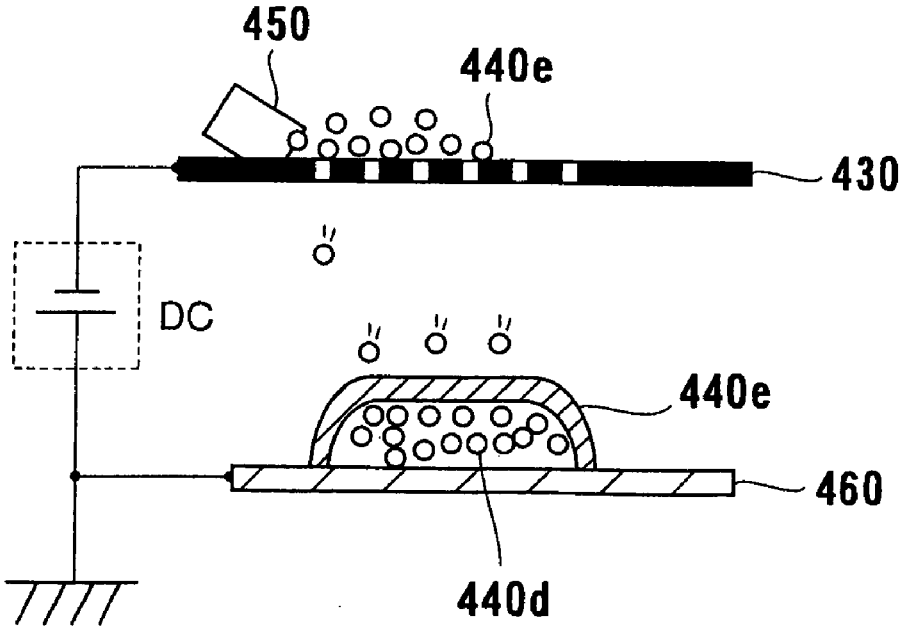
Figure 41:
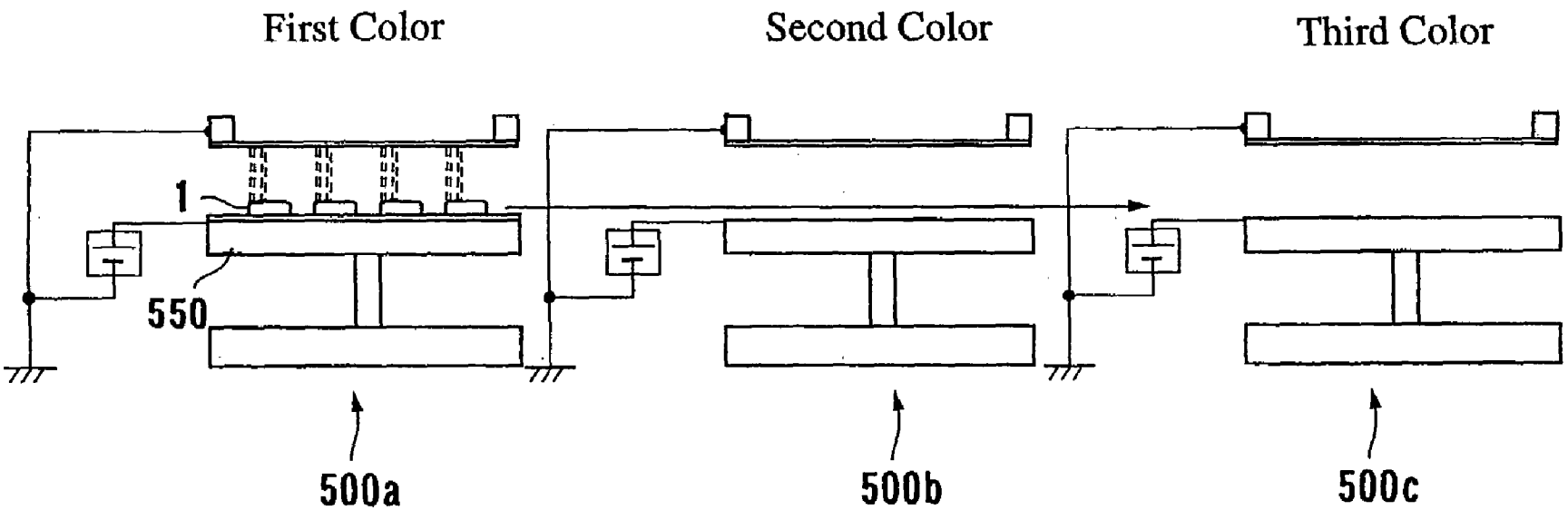
FIG. 41 is a vertical cross-sectional view showing an arrangement of a conventional electrostatic printing apparatus for performing three-colored printing.
Figure 42:
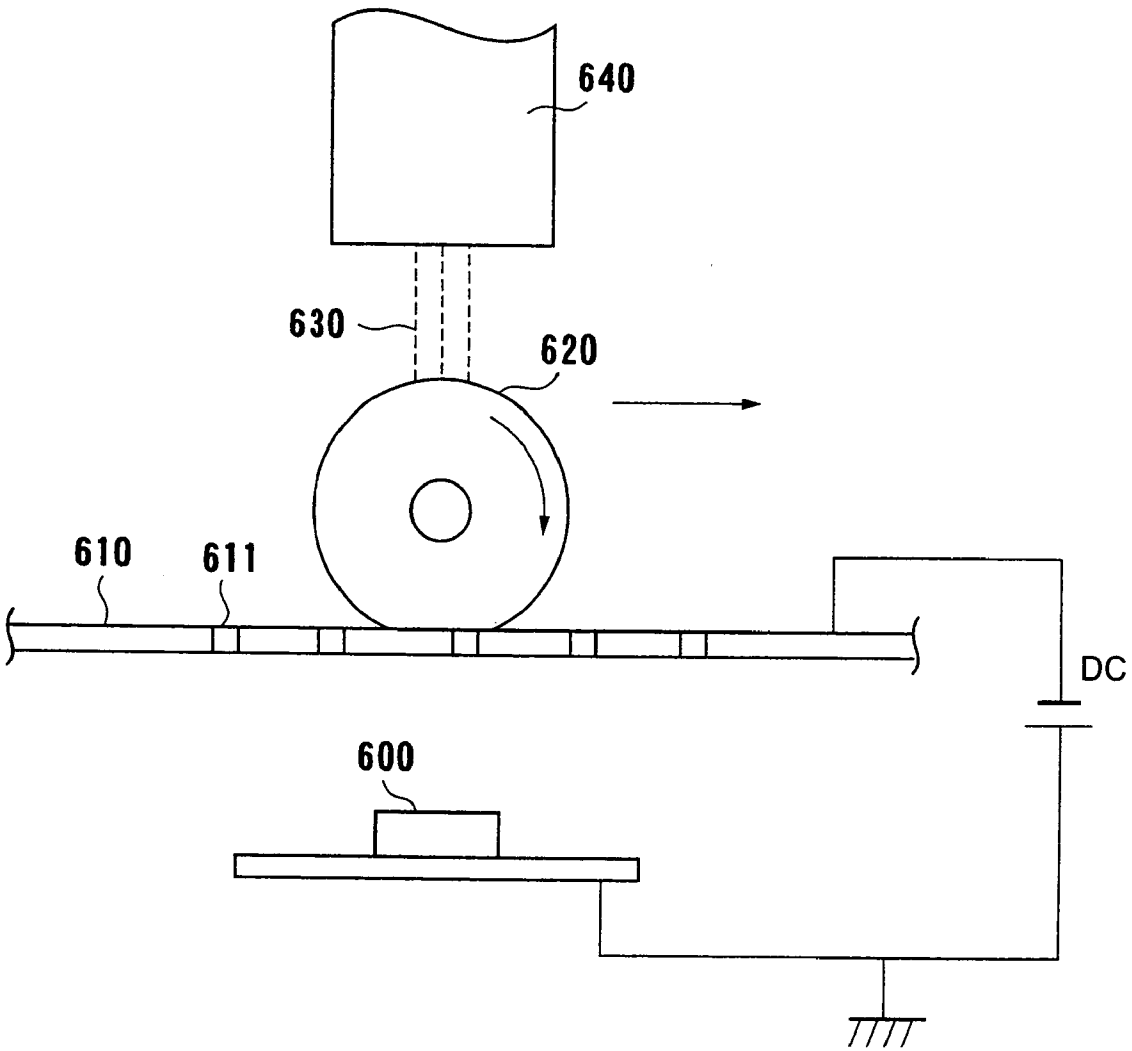
FIG. 42 is a schematic diagram showing a conventional electrostatic printing apparatus.
Figure 43:
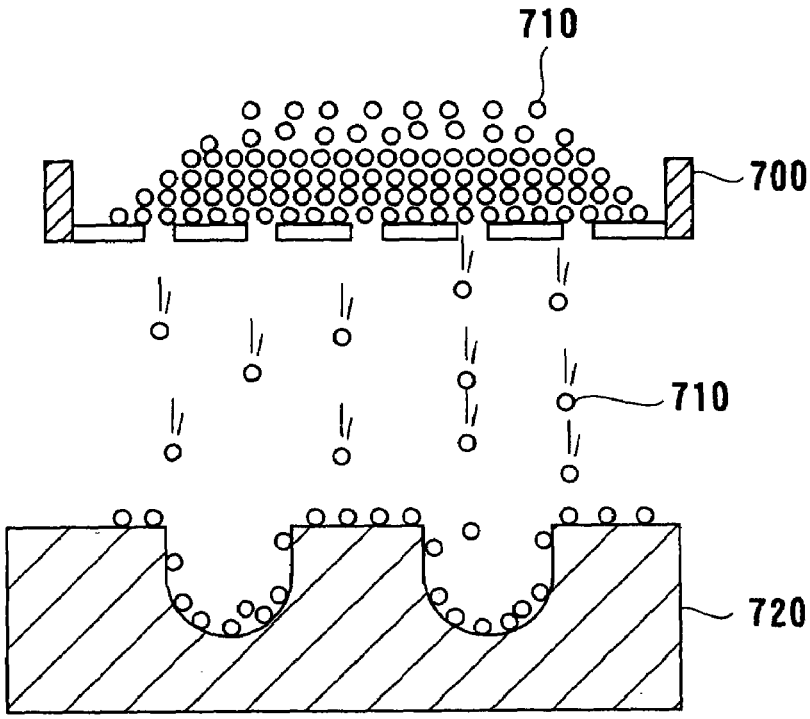
FIG. 43 is a schematic view showing a conventional method of applying edible powder onto a food molding receptacle through a screen.
Figure 44:
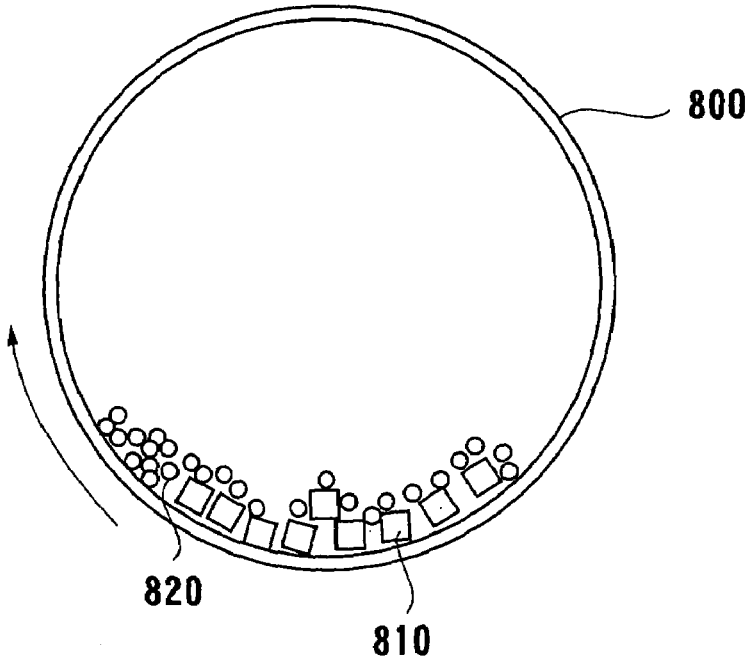
FIG. 44 is a schematic view showing a conventional method of applying edible powder onto a molded food with use of a rotation drum.

FIGS. 40A and 40B are schematic views showing an electrostatic printing apparatus according to a twenty first embodiment of the present invention. In an example shown in FIGS. 40A and 40B, sugar powder 440*d* is applied and accumulated on a process table 460 in a pattern of a screen 430 (FIG. 40A), and baking soda 440*e* is applied and accumulated as baking powder through the same screen 430 (FIG. 40B) and baked. Thus, sugar is burnt and mixed with the baking soda to produce swelled bekkou candy.

In this case, the process table 460 may be in the form of a receptacle and hold water therein. Wheat powder is applied and accumulated within the process table in the form of a receptacle with a pattern of the screen, and baking soda is applied and accumulated as baking powder on the wheat powder through the same screen. Then, the process table is heated to bake the wheat powder. Thus, it is possible to produce a three-dimensional food having irregularities. Alternatively, baking powder is applied and accumulated on a process table fried thereon with a pattern, and the process table is heated to bake the baking powder while water is sprayed. Thus, it is possible to produce a swelled three-dimensional food. According to a food producing method in the present embodiment, which is an unprecedented method, it is possible to readily produce a food having a complicated shape without skill or experience.

Although certain preferred embodiments of the present invention have been described above, the present invention is not limited to the above embodiments. It should be understood that various changes and modifications may be made therein without departing from the scope of the technical concept of the present invention.

INDUSTRIAL APPLICABILITY

The present invention is suitable for use in an electrostatic printing apparatus for attaching powdery ink onto a surface of an object by using an electrostatic force to print a printed pattern including characters and figures on the surface of the object. Further, the present invention is suitable for use in a food producing method using an electrostatic printing apparatus utilizing an electrostatic force.

The invention claimed is:

1. An electrostatic printing apparatus for rubbing powdery ink into a screen having a predetermined printed pattern formed therein, and applying a voltage between said screen and an object so as to attach the powdery ink to the object, said electrostatic printing apparatus characterized by comprising:

a cylindrical screen brush for rubbing powdery ink into said screen; and a screen brush driving mechanism for rotating said screen brush and moving said screen brush in an axial direction.

* * * * *